US006913002B2

(12) United States Patent
Mashimo et al.

(10) Patent No.: US 6,913,002 B2
(45) Date of Patent: Jul. 5, 2005

(54) FUEL FEED SYSTEM

(75) Inventors: Toru Mashimo, Gunma (JP); Hironori Ohhashi, Gunma (JP); Masaaki Iijima, Gunma (JP); Satoru Watanabe, Gunma (JP)

(73) Assignee: Hitachi, Ltd., Kanagawa (JP)

( * ) Notice: Subject to any disclaimer, the term of this patent is extended or adjusted under 35 U.S.C. 154(b) by 0 days.

(21) Appl. No.: 10/724,752

(22) Filed: Dec. 2, 2003

(65) Prior Publication Data

US 2004/0112341 A1 Jun. 17, 2004

(30) Foreign Application Priority Data

Dec. 13, 2002 (JP) ..... 2002-362654
Dec. 13, 2002 (JP) ..... 2002-362655

(51) Int. Cl.[7] ..... F02M 33/02
(52) U.S. Cl. ..... 123/520; 123/495
(58) Field of Search ..... 123/495, 520, 123/198 D, 519, 518, 516, 509; 73/118.1

(56) References Cited

U.S. PATENT DOCUMENTS 5,881,700 A * 3/1999 Gras et al. ..... 123/520
5,975,062 A * 11/1999 Bonse et al. ..... 123/519
6,067,967 A * 5/2000 Kidokoro et al. ..... 123/516
6,695,895 B2 * 2/2004 Hyodo et al. ..... 96/111

FOREIGN PATENT DOCUMENTS

JP 6-10777 A 1/1994

* cited by examiner

*Primary Examiner*—Mahmoud Gimie
(74) *Attorney, Agent, or Firm*—Sughrue Mion, PLLC

(57) ABSTRACT

A fuel feed system for an internal combustion engine includes a fuel tank for accumulating fuel, a fuel/air switchable pump for sucking and discharging accumulated fuel and air outside the fuel tank, a first device that allows accumulated fuel to be discharged to the engine, a second device that allows outside air to be sucked into the fuel tank, and an ECU for controlling the switchable pump.

18 Claims, 16 Drawing Sheets

FUEL FEED SYSTEM

BACKGROUND OF THE INVENTION

The present invention relates to a fuel feed system suitable for fuel feed to automotive engines and the like.

Typically, the fuel feed system mounted on vehicles such as automobile serves to feed fuel, such as gasoline, accumulated in a fuel tank to an engine main body through a fuel pump. Some fuel feed systems include an evapopurge apparatus for discharging fuel vapor evaporated in the fuel tank, i.e. evaporative emission, to the intake side of the engine (refer to JP-A 6-10777).

The evapopurge apparatus comprises a purge passage for evaporative emission extending from the fuel tank to an intake pipe of the engine. Provided to the purge passage are a canister having therein an adsorbent such as activated charcoal, a purge control valve for conducting communication and shutoff of the purge passage between the canister and the intake pipe, and an air introduction valve for introducing air into the canister when the purge control valve is opened. Here, the purge control valve and the air introduction valve are connected to an electronic control unit (ECU) for controlling the engine.

The ECU controls opening and closing of the purge control valve and the air introduction valve in accordance with engine operating conditions to temporarily accumulate in the canister evaporative emission generated in the fuel tank and discharge it into the intake pipe at appropriate timing.

In the event of trouble of the purge control valve or the air introduction valve or damage of the purge passage, evaporative emission may leak in the atmosphere even with discharge thereof stopped by the ECU.

Thus, in the earlier art, an air pump, a pressure sensor, and the like are provided to the purge passage so as to diagnose the gas-tightness thereof. Here, the air pump is connected to the purge passage between the canister and the purge control valve.

When diagnosing the gas-tightness of the purge passage, the purge control valve and the air introduction valve are closed to block the purge passage between the fuel tank and the purge control valve. Then, the air pump is operated to feed air into the blocked purge passage, increasing the pressure therein. Using the pressure sensor, the ECU checks a variation in the pressure within the purge passage. If the pressure is greatly reduced in a short time, it is determined that a leakage occurs in the purge passage, and thus is diagnosed that the system breaks down.

SUMMARY OF THE INVENTION

In the earlier art, the diagnosis of the gas-tightness on the purge passage needs air pump and the like provided thereto. The fuel feed system with evapopurge function comprises numbers of components including fuel tank, fuel pump, canister, purge control valve, air introduction valve, and the like.

Thus, the addition of the air pump for diagnosing the gas-tightness to the fuel feed system causes an increase in weight and size of the system as a whole, forming not only an impediment to a reduction in weight and size of the vehicle, but also a factor that increases manufacturing cost of the fuel feed system.

It is, therefore, an object of the present invention to provide a fuel feed system that contributes to a reduction in weight and size of the system as a whole and also in manufacturing cost thereof with reduced number of components.

The present invention provides generally a system for feeding fuel to an internal combustion engine, which comprises: a tank that accumulates evaporative fuel; a pump that sucks and discharges the accumulated fuel and air outside the tank; a first device that allows the accumulated fuel to be discharged to the engine; a second device that allows the outside air to be sucked into the tank; and an electronic control unit (ECU) that controls the pump.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
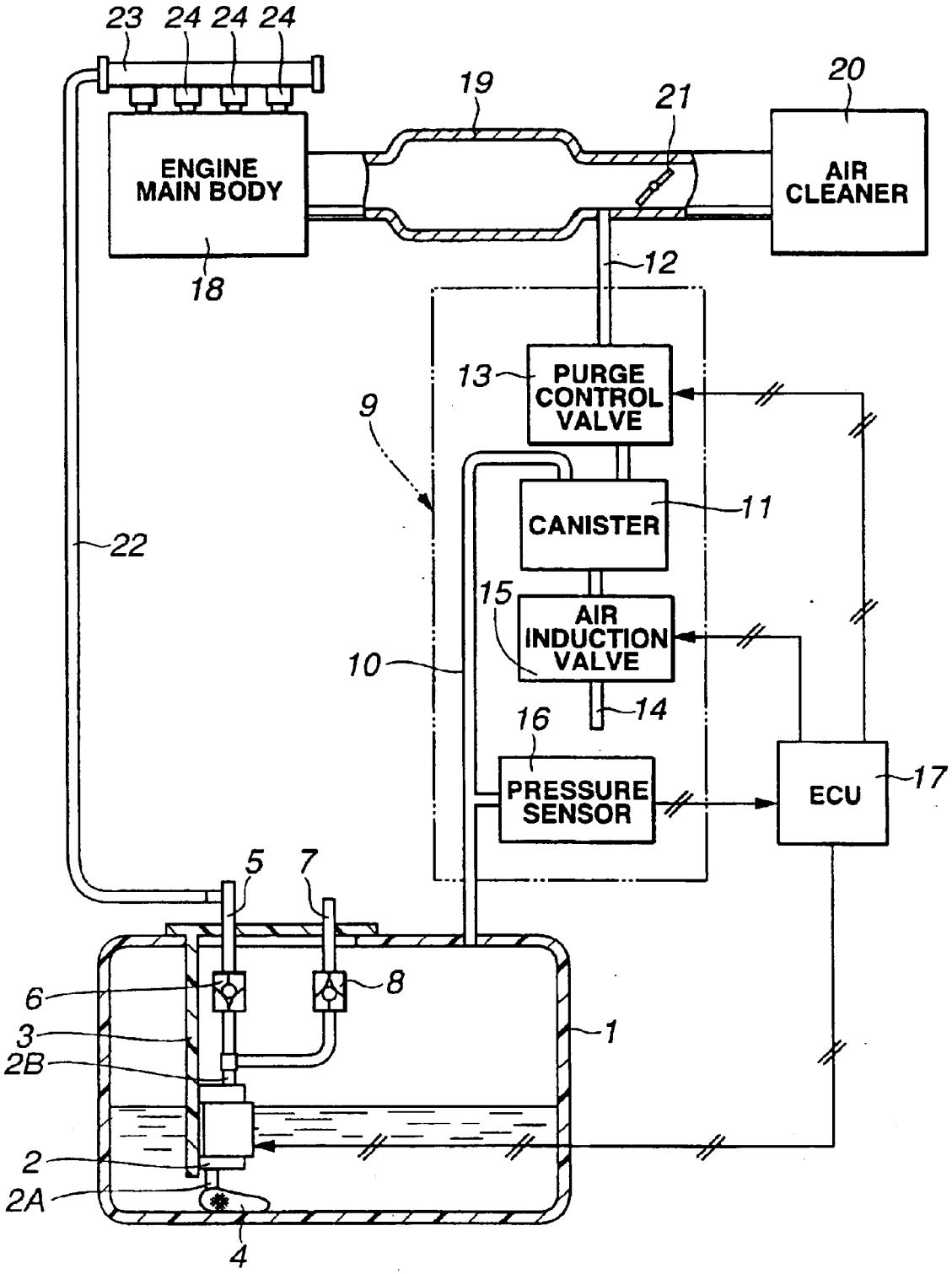
FIG. 1 is a block diagram showing a first embodiment of a fuel feed system according to the present invention.

Referring to the drawings, a fuel feed system embodying the present invention is described in detail. In the illustrative embodiments, the fuel feed system is applied to a vehicle such as automobile.

Referring to FIGS. 1–4, there is shown first embodiment of the present invention. Referring to FIG. 1, the structure of the first embodiment is described.

A fuel tank 1 to be mounted on the vehicle includes a gas-tight closed container formed of a resin material, a metallic material, and the like to accumulate therein evaporative fuel such as gasoline.

A fuel/air switchable pump or pump means 2 is arranged in fuel tank 1, and comprises a general-purpose electric pump. Switchable pump 2 has two circulation ports 2A, 2B that serves as inlet and outlet ports as will be described later. Switchable pump 2 is mounted to the inside of fuel tank 1 through a bracket 3 and the like, and is connected to an electronic control unit (ECU) 17 as will be described later.

Switchable pump 2 is a combination of a fuel pump for feeding fuel to an engine main body 18 as will be described later and an air pump used for diagnosing the gas-tightness of an evapopurge apparatus 9 as will be described later and the like, and thus can suck and discharge fuel and air. Switchable pump 2 is rotated in the normal direction or in the reverse direction in accordance with the polarity and the like of a drive signal derived from ECU 17.

Figure 2:
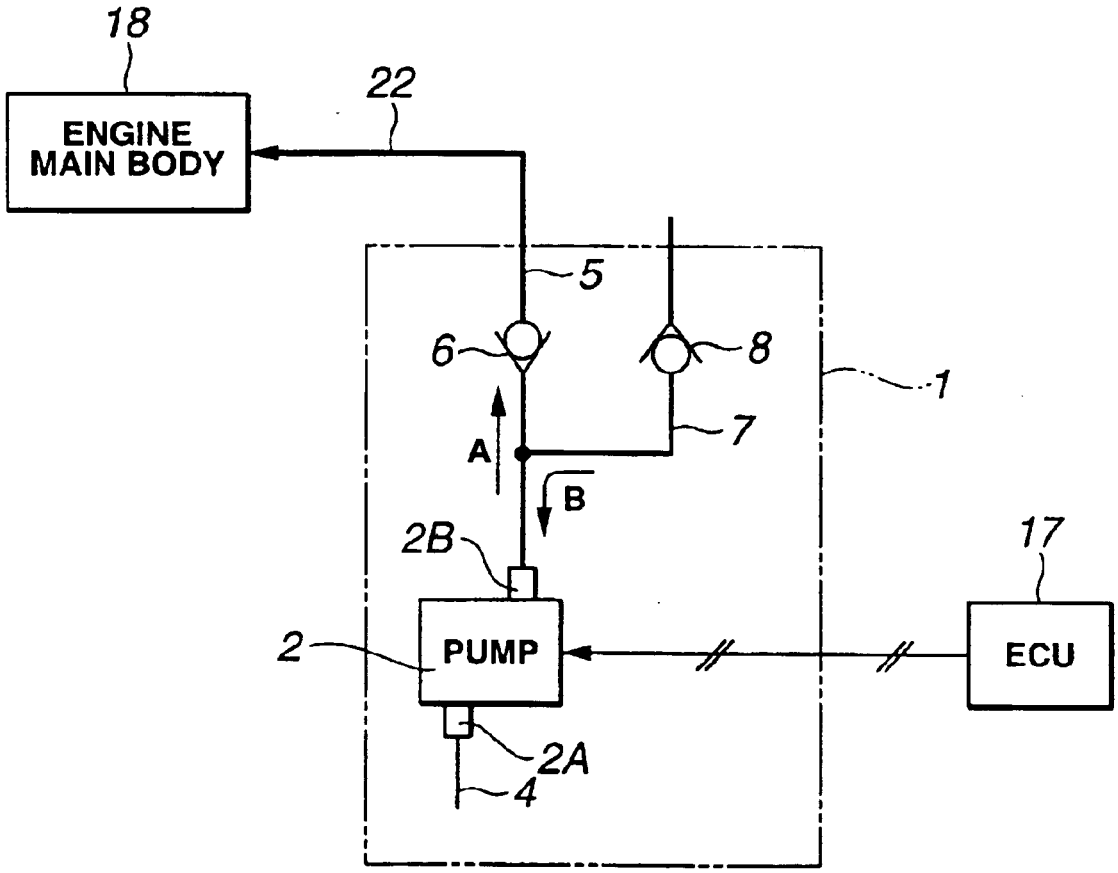
FIG. 2 is a circuit diagram showing connection between a switchable pump, fuel delivery valve, air intake valve, and the like in FIG. 1.

Referring to FIG. 2, switchable pump 2 operates as a fuel pump when rotated in the normal direction, i.e. during normal rotation, wherein lower circulation port 2A serves as a fuel inlet port, and upper circulation port 2B serves as a fuel outlet port. Thus, circulation port 2A is provided with an intake filter 4 for clarifying fuel sucked in switchable pump 2. During normal rotation, switchable pump 2 sucks fuel in fuel tank 1 through circulation port 2A, which is discharged to a fuel delivery pipe 5 as will be described later through circulation port 2B as shown by arrow A in FIG. 2.

When conducting gas-tightness diagnosis processing as will be described later, switchable pump 2 is rotated in the reverse direction to operate as an air pump, wherein circulation port 2B serves as an air inlet port, and circulation port 2A serves as an air outlet port. Thus, switchable pump 2 sucks air outside fuel tank 1 from an air intake pipe 7 as will be described later through circulation port 2B to discharge it into fuel tank 1 through circulation port 2A as shown by arrow B in FIG. 2.

Fuel delivery pipe 5 is connected to circulation port 2B of switchable pump 2, and protrudes outward from fuel pump 1 through bracket 3 and the like, the protruding end of which is connected to a first fuel feed pipe 22 as will be described later. When switchable pump 2 operates as a fuel pump, discharged fuel is fed to injection valves 24 of engine main body 18 through fuel delivery pipe 5 and the like.

A fuel delivery valve 6 comprising a check valve is provided to fuel delivery pipe 5. During normal rotation of switchable pump 2, fuel delivery valve 6 allows fuel to be discharged to engine main body 18 through fuel delivery pipe 5. When switchable pump 2 operates as an air pump to suck air from air intake pipe 7, fuel delivery valve 6 prevents, through its intake action, fuel of engine main body 18 from being sucked in fuel delivery pipe 5 or flowing backward.

Air intake pipe 7 is connected to circulation port 2B together with fuel delivery pipe 5, and protrudes outward from fuel tank 1 through bracket 3 and the like, the protruding end of which opens into an outer space.

When switchable pump 2 operates as an air pump, air outside fuel tank 1 is fed therein through air intake pipe 7. Then, since a purge control valve 13 and an air introduction valve 15 as will be described later are closed, the gas-tightness diagnosis can be conducted on fuel tank 1, evapopurge apparatus 9, and the like.

An air intake valve 8 comprising a check valve is provided to air intake pipe 7. During reverse rotation of switchable pump 2, air intake valve 8 allows air outside fuel tank 1 to be sucked therein through air intake pipe 7. When switchable pump 2 operates as a fuel pump to discharge fuel from fuel delivery pipe 5, air intake valve 8 prevents discharged fuel from flowing outside through air intake pipe 7.

Evapopurge apparatus 9 to be mounted on the vehicle together with fuel tank 1 comprises pipes 10, 12, 14, a canister 11 as will be described later, purge control valve 13, air introduction valve 15, and the like. When the engine is operated under predetermined conditions as will be described later, evapopurge apparatus 9 conducts communication between fuel tank 1 and an intake pipe 19 of engine main body 18, wherein evaporative emission generated in fuel tank 1 is discharged into intake pipe 19 through canister 11.

Tank-side pipe 10 is connected to fuel tank 1, and has one end opening into a space in fuel tank 1 and another end connected to canister 11.

Canister 11 has an adsorbent, not shown, such as activated charcoal accommodated therein, and includes a gas-tight closed container. Canister 11 adsorbs in its adsorbent evaporative emission flowing from fuel tank 1 through tank-side pipe 10 for temporal accumulation thereof.

Engine-side pipe 12 serves to flow evaporative emission into intake pipe 19, and has one end connected to canister 11 and another end connected to intake pipe 19.

Purge control valve 13 comprising a solenoid valve is provided to engine-side pipe 12, and has an inlet port connected to canister 11 and an outlet port connected to intake pipe 19. Purge control valve 13 is opened and closed by ECU 17 to conduct communication and shutoff of engine-side pipe 12.

When purge control valve 13 is opened, the negative pressure generated in intake pipe 19 during engine operation, i.e. intake depression, is applied to canister 11 through engine-side pipe 12, purge control valve 13, and the like, thereby sucking and discharging evaporative emission in fuel tank 1 into intake pipe 19 through canister 11 and the like.

Air introduction pipe 14 serves to introduce air or atmospheric pressure into canister 11, and has one end opening into the atmosphere and another end connected to canister 11.

Air introduction valve 15 comprising a solenoid valve is provided to air introduction pipe 14. Air introduction valve 15 is opened and closed by ECU 17 to conduct communication and shutoff of air introduction pipe 14. When purge control valve 13 is opened to apply engine-side intake depression to canister 11, air introduction valve 15 is opened to introduce air into canister 11 through air introduction pipe 14.

When purge control valve 13 and air introduction valve 15 are closed, spaces in fuel tank 1, tank-side pipe 10, canister 11, and engine-side pipe 12 form closed spaces isolated with respect to intake pipe 19 and the outside. Then, by increasing the pressure within the closed spaces by switchable pump 2, gas-tightness diagnosis processing is conducted to diagnose the gas-tightness of the closed spaces.

A pressure sensor 16 serves to sense the pressure within fuel tank 1 and the like so as to conduct gas-tightness diagnosis processing. Specifically, pressure sensor 16 senses the pressure within the spaces closed by purge control valve 13 and air introduction valve 15 with the gas-tightness maintained, i.e. spaces in fuel tank 1, tank-side pipe 10, canister 11, and engine-side pipe 12. In the first embodiment, pressure sensor 16 is provided to tank-side pipe 10 to output a sensed signal to ECU 17.

ECU or diagnosis means 17 to be mounted on the vehicle comprises a microcomputer and conducts engine control, evapopurge control, gas-tightness diagnosis processing, and the like as will be described later. ECU 17 has an input side connected to pressure sensor 16 and the like and an output side connected to switchable pump 2, purge control valve 13, air introduction valve 15, injection valves 24, and the like.

When conducting engine control, ECU 17 outputs to switchable pump 2 a drive signal with a predetermined polarity so as to drive switchable pump 2 as a fuel pump together with injection valves 24 and the like. With this, fuel in fuel tank 1 is fed to engine main body 18 by switchable pump 2, and is injected from injection valves 24 into engine cylinders, not shown.

In addition to engine control, ECU 17 conducts epavopurge control. At evapopurge control, when the engine is operated under predetermined conditions (for example, when a throttle valve 21 as will be described later is in medium opening except full opening and full closing), purge control valve 13 and air introduction valve 15 are opened. Otherwise, purge control valve 13 and air introduction valve 15 are closed. With this, evaporated emission generated in fuel tank 1 is accumulated in canister 11, which is discharged into intake pipe 19 at appropriate timing.

When the engine stops, for example, ECU 17 conducts gas-tightness diagnosis on various components such as fuel tank 1, tank-side pipe 10, canister 11, engine-side pipe 12, purge control valve 13, and air introduction valve 15. At gas-tightness diagnosis processing, purge control valve 13 and air introduction valve 15 are closed, and a drive signal with reverse polarity to that at engine control, for example, is output to switchable pump 2 so as to drive it as an air pump. With this, the pressure within fuel tank 1 is increased by switchable pump 2, which is sensed by pressure sensor 16. In accordance with the sensed pressure, ECU 17 determines whether or not the gas-tightness of the components is maintained, thereby conducting the trouble diagnosis thereon.

Engine main body 18 is to be mounted on the vehicle as part of an internal combustion engine. Intake pipe 19 serves to suck outside air as intake air into cylinders of engine main body 18, and has one end connected to the cylinders and another end connected to an air cleaner 20 for clarifying intake air. Throttle valve 21 is provided to intake pipe 19 so as to control the intake-air amount of engine main body 18. First fuel feed pipe 22 serves to feed fuel in fuel tank 1 to engine main body 18, and has one end connected to fuel delivery pipe 5 and another end connected to a second fuel feed pipe 23 of engine main body 18. Injection valves 24 are provided to second fuel pipe 23 so as to inject fuel into the cylinders.

Figure 3:
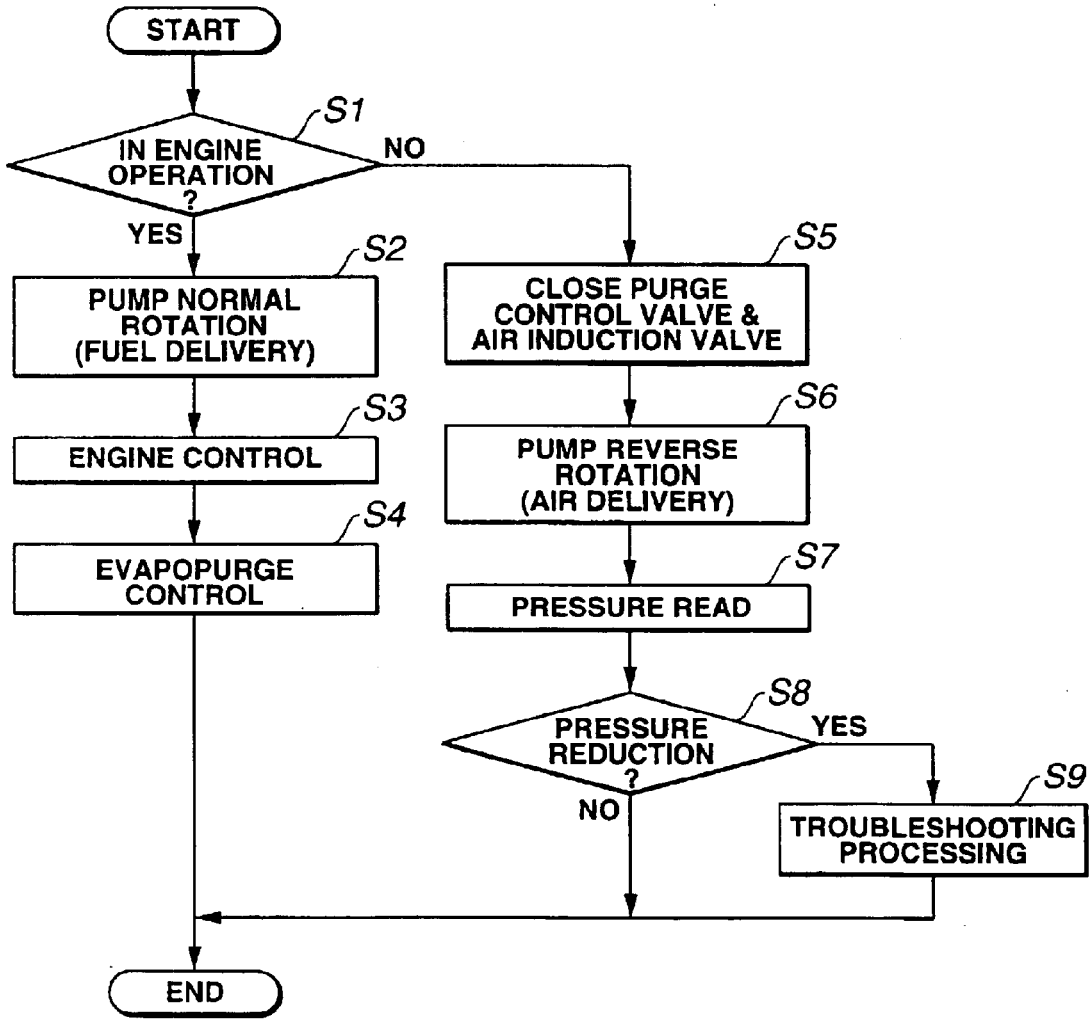
FIG. 3 is a flow chart illustrating the operation of the first embodiment.

Next, referring to FIG. 3, the operation of the first embodiment is described.

Figure 4:
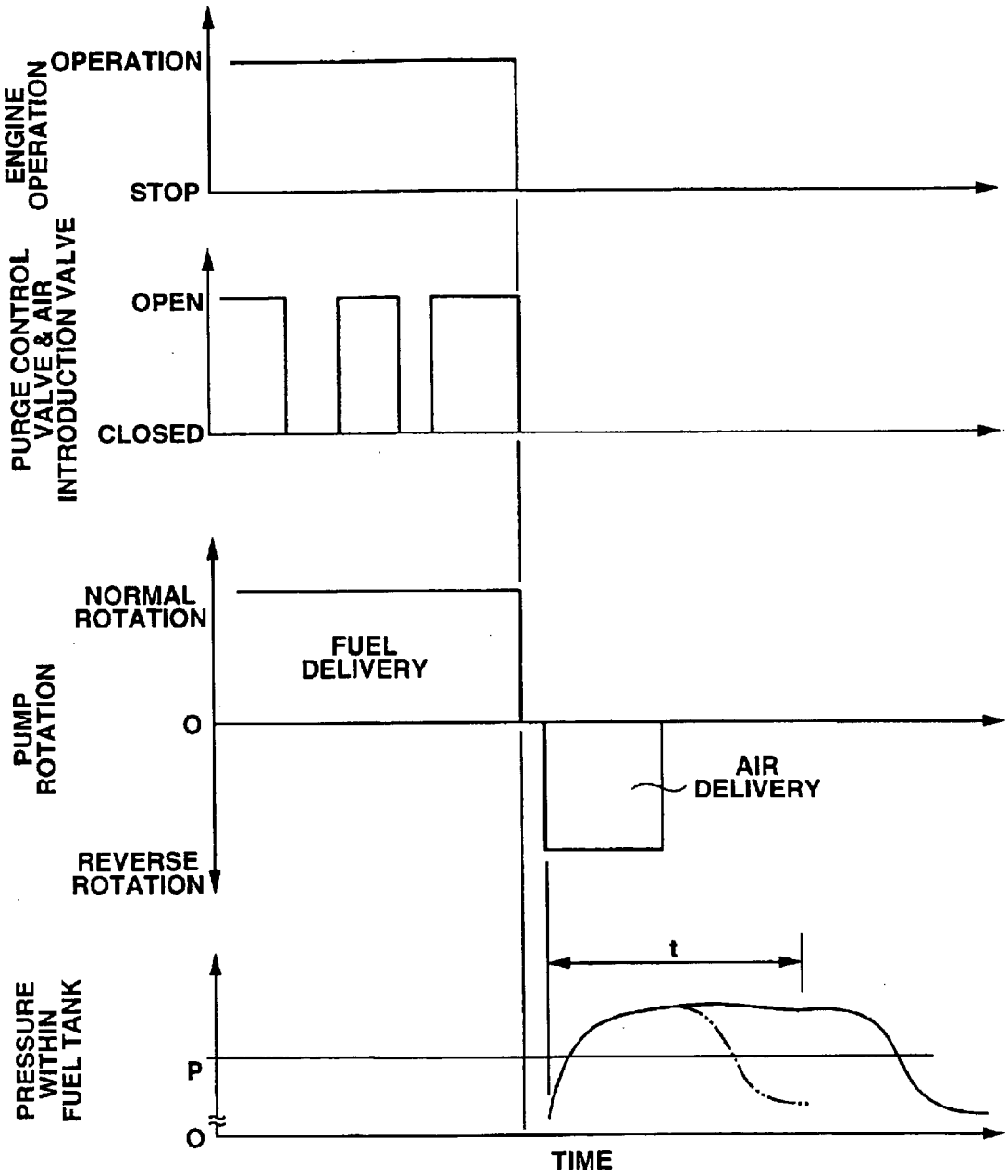
FIG. 4 is a characteristic chart showing the operating state of an engine, purge control valve, air introduction valve, and pump and the pressure within a fuel tank.

At a step S1, it is determined whether or not the engine is in operation. If it is determined that the answer is YES, flow proceeds to a step S2 where a normal-rotation drive signal is output to switchable pump 2 so as to rotate it in the normal direction as shown in FIG. 4. Then, switchable pump 2 is driven as a fuel pump. With this, fuel in fuel tank 1 is fed to engine main body 18 by switchable pump 2. At a subsequent step S3, engine control is conducted, such as fuel injection control with injection valves 24 or the like.

At a step S4, evapopurge control is conducted to open and close purge control valve 13 and air introduction valve 15 in accordance with engine operating conditions. With this, when a driver maintains throttle valve 21 in medium opening, for example, evaporated emission generated in fuel tank 1 is discharged into intake pipe 19 through evapopurge apparatus 9. In this case, undergoing the negative pressure generated in intake pipe 19, i.e. intake depression, at a position closer to engine main body 18 than throttle valve 21, evaporated emission is sucked into the cylinders without leaking outside for burning with intake air.

On the other hand, at step S1, if it is determined that the answer is NO, i.e. the engine is stopped, flow proceeds to a step S5 where purge control valve 13 and air introduction valve 15 are both closed to isolate fuel tank 1, evapopurge apparatus 9, and the like with respect to the outside so as to conduct gas-tightness diagnosis processing.

At a step S6, a reverse-rotation drive signal is output to switchable pump 2 so as to operate it as an air pump for a predetermined time, feeding air outside fuel tank 1 thereinto by switchable pump 2. With this, the pressure within fuel tank 1 with the gas-tightness maintained is increased to a higher value than a predetermined evaluation value P as shown in FIG. 4.

At a step S7, it is read the pressure within fuel tank 1 sensed by pressure sensor 16. At a step S8, it is determined whether or not a sensed value of the pressure is reduced under evaluation value P within a predetermined time "t" with respect to starting time of switchable pump 2, for example.

At step S8, if it is determined that the answer is YES, the pressure within fuel tank 1 is reduced in a short time as shown by imaginary line in FIG. 4, for example, so that it is diagnosed that the gas-tightness is decreased due to trouble or damage of any of the components such as fuel tank 1, tank-side pipe 10, canister 11, engine-side pipe 12, purge control valve 13, air introduction valve 15, and the like.

Then, flow proceeds to a step S9 where troubleshooting processing is conducted, and it comes to an end. Thus, the trouble diagnosis on the fuel feed system with evapopurge function and its troubleshooting can be carried out securely, resulting in enhanced reliability of the system.

On the other hand, at step S8, if it is determined that the answer is NO, the gas-tightness of the components is maintained as shown by solid line in FIG. 4, so that it is diagnosed that all the components are normal. Then, flow comes to an end without conducting processing at step S9.

In the first embodiment, switchable pump 2 is driven as a fuel pump or an air pump in accordance with its direction of rotation, and fuel delivery valve 6 and air intake valve 8 are arranged accordingly. Thus, during engine operation, switchable pump 2 can be operated as a fuel pump, wherein air intake valve 8 can securely prevent discharged fuel of switchable pump 2 from flowing outside through air intake pipe 7. With this, fuel in fuel tank 1 can stably be fed to engine main body 18, resulting in favorable operation of the engine.

Further, during engine stop, switchable pump 2 can be operated as an air pump to conduct gas-tightness diagnosis processing, wherein fuel delivery valve 6 can securely prevent fuel of engine main body 18 from flowing backward in fuel delivery pipe 5 due to suction of air by switchable pump 2.

At gas-tightness diagnosis processing, the pressure within fuel tank 1, evapopurge apparatus 9, and the like can be increased by switchable pump 2, wherein a pressure variation is sensed to allow secure gas-tightness diagnosis on fuel tank 1, evapopurge apparatus 9, and the like.

Therefore, switchable pump 2 can be obtained easily using a general-purpose pump, check valve, and the like, achieving a combination of a fuel pump and an air pump. Moreover, by only inputting a normal-rotation drive signal or a reverse-rotation drive signal to switchable pump 2, the operating state of switchable pump 2 can be switched stably.

Thus, the fuel feed system needs no separate and distinct pumps for conducting fuel feed and gas-tightness diagnosis, resulting in a reduction in number of components such as pump. This also results in a reduction in weight and size of the system as a whole and in manufacturing cost thereof, and thus excellent mountability of the system with evapopurge function on the vehicle and the like.

Further, since switchable pump 2 is designed to be arranged in fuel tank 1, an installation space for switchable pump 2 can easily be secured through the use of a space in fuel tank 1, resulting in a reduction in number of components arranged outside of fuel tank 1 and in its installation space. Moreover, since switchable pump 2 serves as both a fuel pump and an air pump, the tank capacity can fully be secured as compared with separate and distinct arrangement of two pumps in fuel tank 1.

Therefore, during the design of vehicles, the layout of switchable pump 2 and the like can efficiently be conducted through the use of fuel tank 1. Moreover, by accommodating switchable pump 2 and the like in fuel tank 1, an installation space for other components can be increased outside fuel tank 1, resulting in effective use of a limited space of the vehicle.

Figure 5:
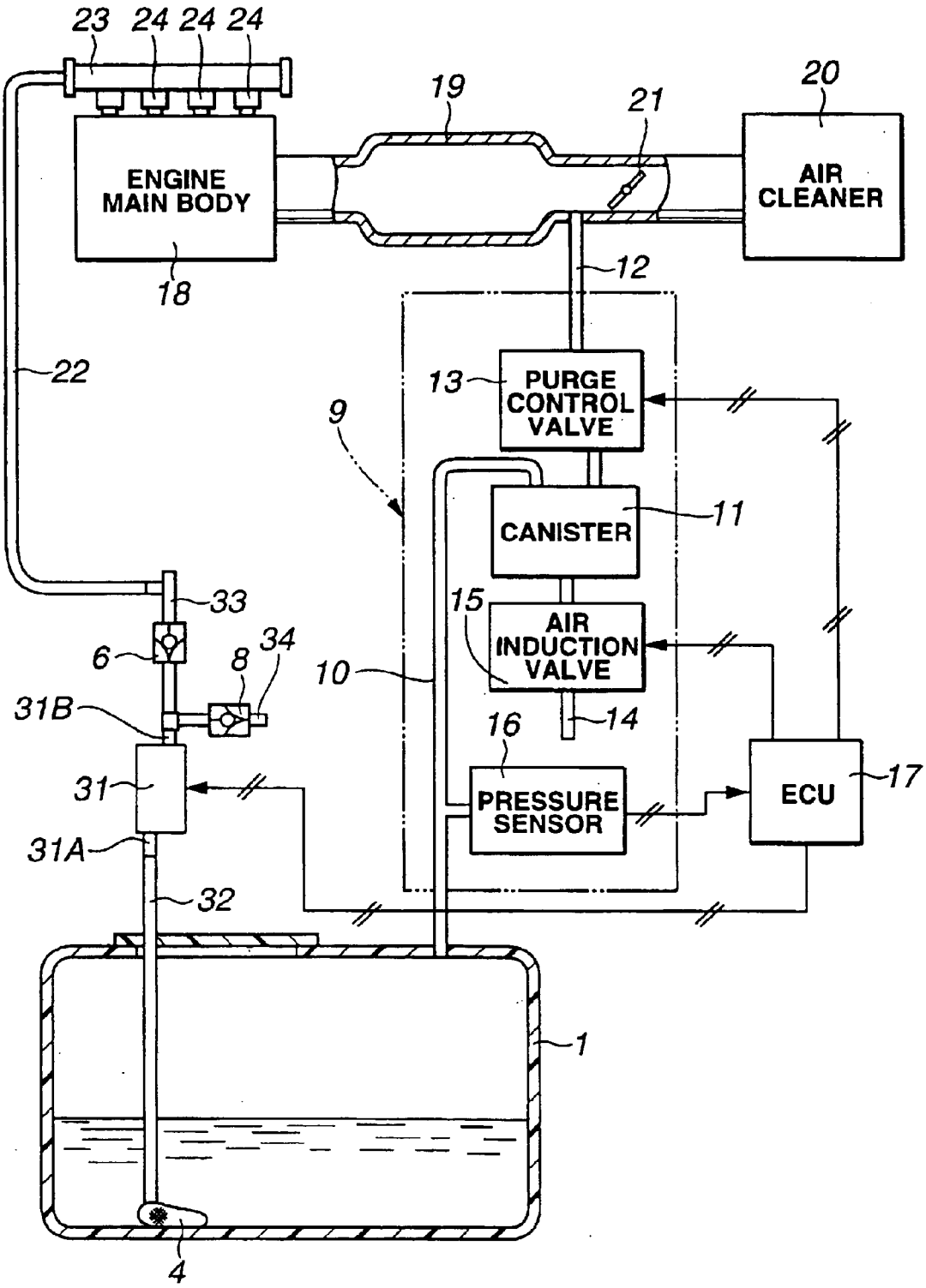
FIG. 5 is a diagram similar to FIG. 1, showing a second embodiment of the present invention.

Referring to FIG. 5, there is shown second embodiment of the present invention that is substantially the same in structure as the first embodiment except pump means are arranged outside the fuel tank.

A fuel/air switchable pump or pump means 31, which is constructed in a roughly similar way to the pump 2 in the first embodiment, includes two circulation ports 31A, 31B, and is rotated in the normal direction or in the reverse direction in accordance with a drive signal derived from ECU 17.

However, switchable pump 31 is arranged outside fuel tank 1, wherein connected to lower circulation port 31A is a tank connection pipe 32 extending in fuel tank 1 and having an end mounted to intake filter 4.

In a roughly similar way to in the first embodiment, connected to upper circulation port 31B are a fuel delivery pipe 33 connected to engine main body 18 and an air intake pipe 34 opening into a space outside fuel tank 1. Fuel delivery valve 6 is provided to fuel delivery pipe 33, and air intake valve 8 is provided to air intake pipe 34.

Thus, the second embodiment produces substantially the same effect as that of the first embodiment. Particularly, in the second embodiment, switchable pump 31 can be arranged outside fuel tank 1 considering the structure of fuel tank 1 and the routing of pipes 32–34, for example, resulting in enhancement in design flexibility of the fuel feed system.

Figure 6:
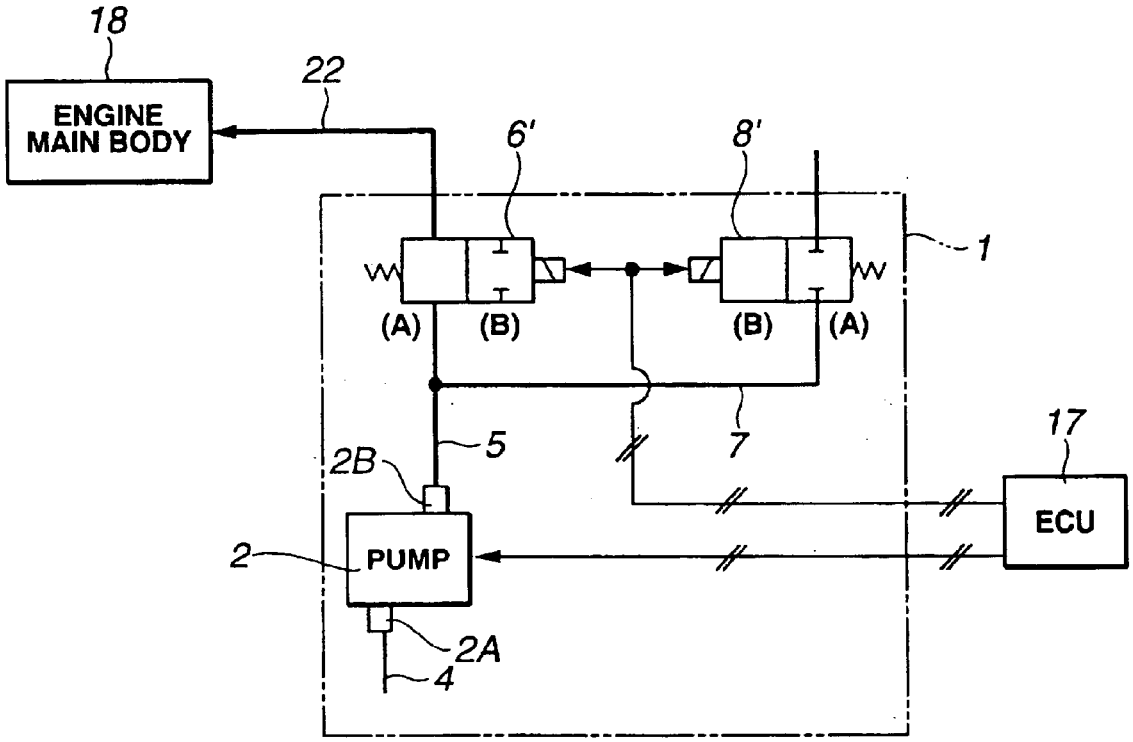
FIG. 6 is a diagram similar to FIG. 2, showing a third embodiment of the present invention.

In the first and second embodiments, fuel delivery valve 6 and air intake valve 8 include a check valve. Optionally, referring to FIG. 6, the two valves may be constructed as shown in the third embodiment, wherein a fuel delivery valve 6' includes a normally-open solenoid open/close valve or the like, and an air intake valve 8' includes a normally-closed solenoid open/close valve or the like. When switchable pump 2 is driven as a fuel pump, fuel delivery valve 6' and air intake valve 8' receive no switching signal from ECU 17, and thus are maintained at respective fuel delivery positions (A), wherein fuel delivery valve 6' is opened, and air intake valve 8' is closed. On the other hand, when switchable pump 2 is driven as an air pump, fuel delivery valve 6' and air intake valve 8' receive switching signals from ECU 17, and thus are switched to respective air intake positions (B), wherein fuel delivery valve 6' is closed, and air intake valve 8' is opened.

Figure 7:
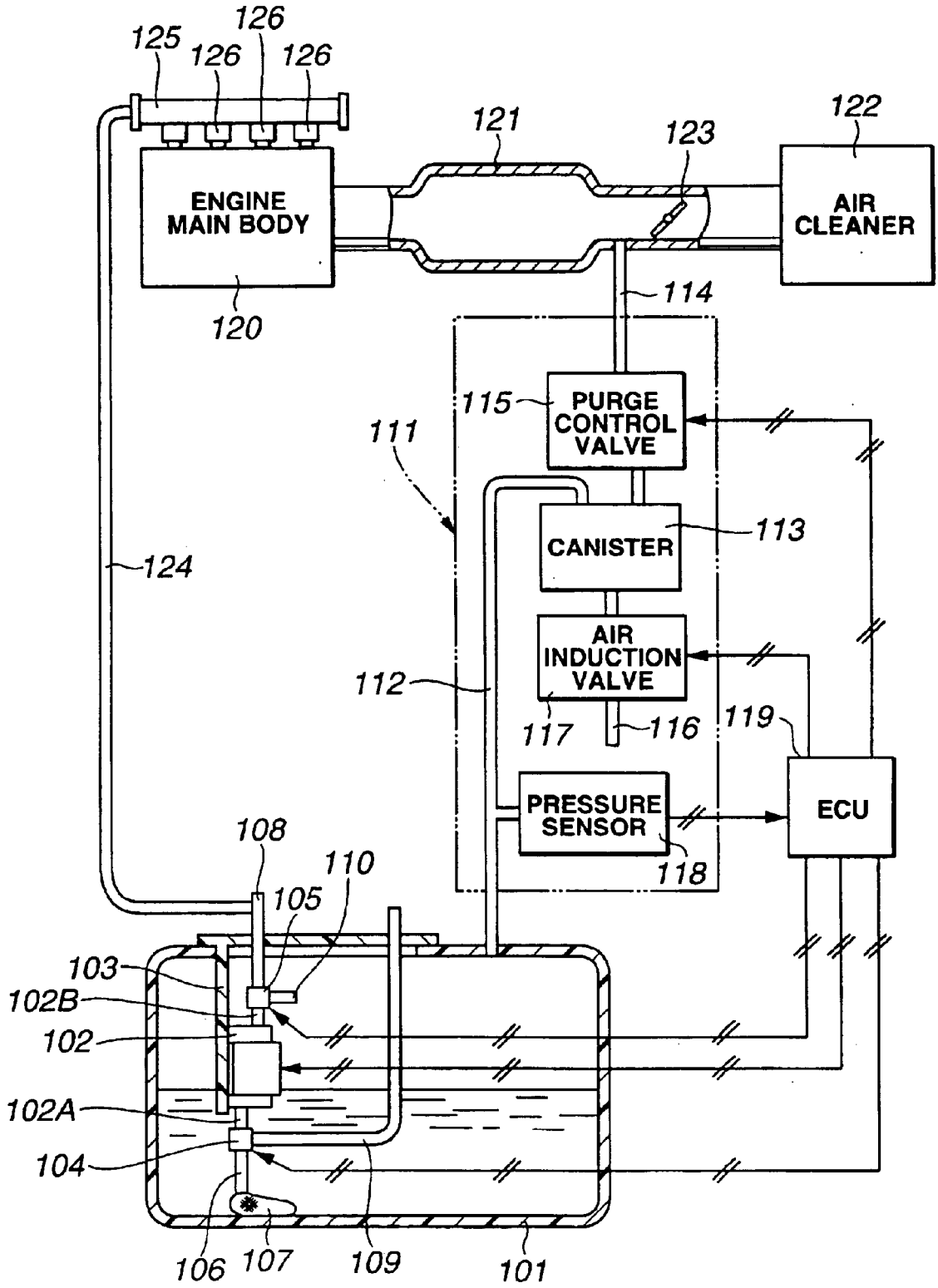
FIG. 7 is a diagram similar to FIG. 5, showing a fourth embodiment of the present invention.

Referring to FIGS. 7–11, there is shown fourth embodiment of the present invention. Referring to FIG. 7, the structure of the fourth embodiment is described.

A fuel tank 101 to be mounted on the vehicle includes a gas-tight closed container formed of a resin material, a metallic material, and the like to accumulate therein evaporative fuel such as gasoline.

A fuel/air switchable pump or pump means 102 is arranged in fuel tank 101, and comprises a general-purpose electric pump. Switchable pump 102 has two circulation ports 102A, 102B that serves as inlet and outlet ports as will be described later. Switchable pump 102 is mounted to the inside of fuel tank 101 through a bracket 103 and the like, and is connected to an electronic control unit (ECU) 119 as will be described later.

Switchable pump 102 is a combination of a fuel pump for feeding fuel to an engine main body 120 as will be described later and an air pump used for diagnosing the gas-tightness of an evapopurge apparatus 111 as will be described later and the like, and thus can suck and discharge fuel and air.

Figure 9:
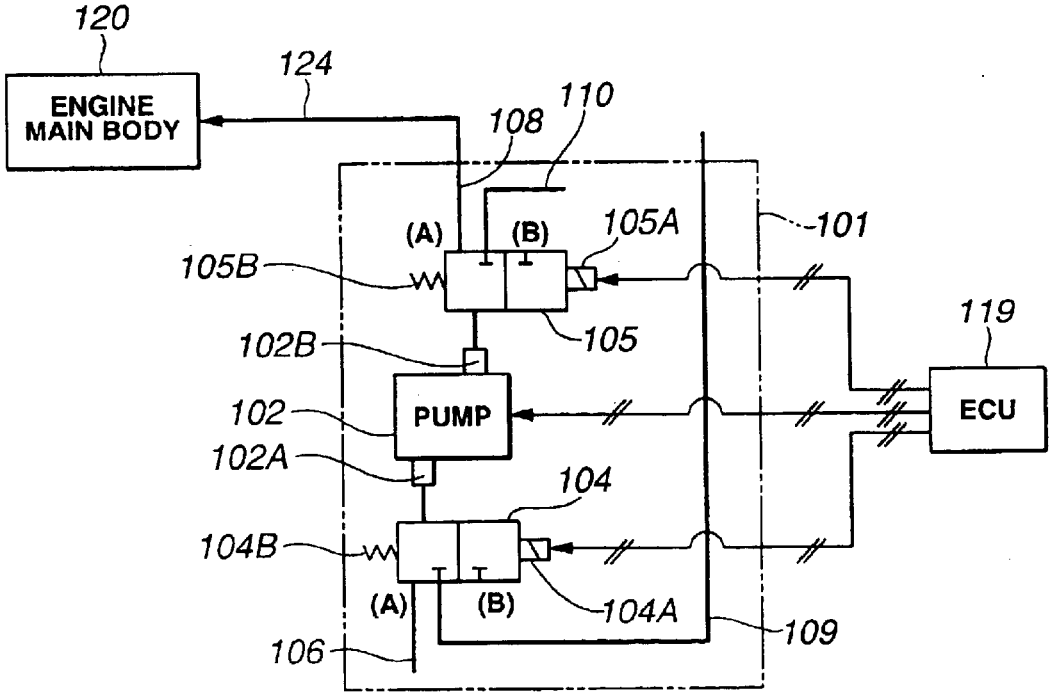
FIG. 9 is a diagram similar to FIG. 2, showing connection between the fuel tank, switchable pump, selector valve, and the like in FIG. 7.

Referring to FIG. 9, when selector valves 104, 105 are switched to respective fuel-pump positions (A), switchable pump 102 is driven as a fuel pump to suck fuel in fuel tank 101 from a fuel intake pipe 106 through an inlet port 102A and discharge it to a fuel delivery pipe 108 through an outlet port 102B.

Intake-side selector valve or first switching means 104 is provided to inlet port 102A of switchable pump 102. As shown in FIG. 9, selector valve 104 includes a 3-port 2-position solenoid-type selector valve, comprising a solenoid pilot part 104A and a return spring 104B. Selector valve 104 serves to switchably connect inlet port 102A of switchable pump 102 to one of intake pipes 106, 109.

When ECU 119 provides no switching signal to solenoid pilot part 104A, selector valve 104 is maintained at fuel-pump position (A) by return spring 104B to connect inlet port 102A to fuel intake pipe 106 and shut off inlet port 102A from air intake pipe 109. On the other hand, when a switching signal is input to solenoid pilot part 104A, selector valve 104 is switched to an air-pump position (B) to shut off inlet port 102A from fuel intake pipe 106 and connect inlet port 102A to air intake pipe 109.

Delivery-side selector valve or second switching means 105 is provided to outlet port 102B of switchable pump 102. In a roughly similar way to intake-side selector valve 104, delivery-side selector valve 105 includes a solenoid-type selector valve, comprising a solenoid pilot part 105A and a return spring 105B. Through its opening and closing operation together with selector valve 104, selector valve 105 serves to switchably connect outlet port 102B of switchable pump 102 to one of delivery pipes 108, 110.

When ECU 119 provides no switching signal to solenoid pilot part 105A, selector valve 105 is maintained at fuel-pump position (A) by return spring 105B to connect outlet port 102B to fuel delivery pipe 108 and shut off outlet port 102B from air delivery pipe 110. On the other hand, when a switching signal is input to solenoid pilot part 105A, selector valve 105 is switched to air-pump position (B) to shut off outlet port 102B from fuel delivery pipe 108 and connect outlet port 102B to air delivery pipe 110.

Figure 8:
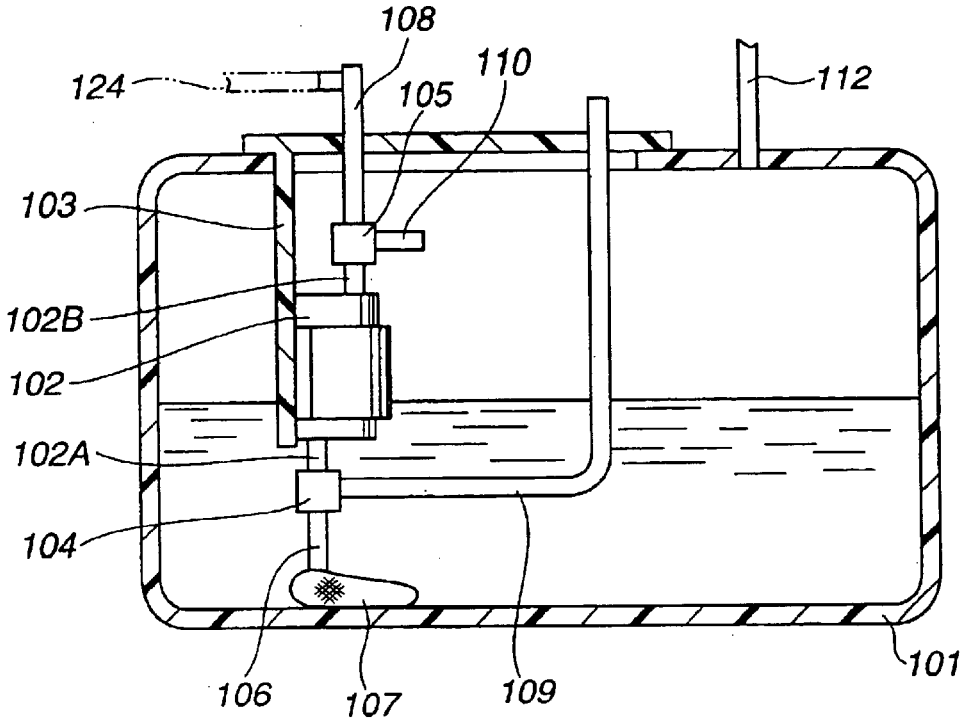
FIG. 8 is an enlarged sectional view showing the fuel tank, switchable pump, selector valve, and the like in FIG. 7.

Fuel intake pipe 106 is operative at fuel-pump position (A), and serves to lead fuel in fuel tank 101 to switchable pump 102. Referring to FIG. 8, fuel intake pipe 106 has a base end connected to an inlet port of intake-side selector valve 104, and a front end connected to an intake filter 107 located in fuel tank 101 for clarifying fuel sucked into fuel intake pipe 106.

Fuel delivery pipe 108 is operative at fuel-pump position (A), and serves to lead fuel from switchable pump 102 to an engine main body 120. Fuel delivery pipe 108 has a base end connected to an outlet port of delivery-side selector valve 105, and a front end protruding outward from fuel tank 101 through a bracket 103 and the like and connected to a fuel feed pip 124 as will be described later.

When switchable pump 102 operates as a fuel pump, discharged fuel is delivered outside fuel tank 101 through fuel delivery pipe 108, and is fed to injection valves 126 of engine main body 120.

Air intake pipe 109 is operative at air-pump position (B), and serves to lead air outside fuel tank 101 to switchable pump 102. Air intake pipe 109 has a base end connected to the inlet port of intake-side selector valve 104 together with fuel intake pipe 106, and a front end extending outward of fuel tank 101 through bracket 103 and the like and communicating with an outside space.

Air delivery pipe 110 is operative at air-pump position (B), and serves to lead air from switchable pump 102 to fuel tank 101. Air delivery pipe 110 has a base end connected to the outlet port of delivery-side selector valve 105 together with fuel delivery pipe 108, and a front end opening into a space in fuel tank 101.

When switchable pump 102 operates as an air pump, discharged air is fed into fuel tank 101 through air delivery pipe 110. Then, since a purge control valve 115 and an air introduction valve 117 as will be described later are closed, the pressure within fuel tank 101, evapopurge apparatus 111, and the like is increased to allow the gas-tightness diagnosis thereon.

Evapopurge apparatus 111 to be mounted to the vehicle together with fuel tank 101 comprises pipes 112, 114, 116, a canister 113 as will be described later, purge control valve 115, air introduction valve 117, and the like. When the engine is operated under predetermined conditions as will be described later, evapopurge apparatus 111 conducts communication between fuel tank 101 and an intake pipe 121 of engine main body 120, wherein evaporative emission generated in fuel tank 101 is discharged into intake pipe 121 through canister 113.

Tank-side pipe 112 is connected to fuel tank 101, and has one end opening into a space in fuel tank 101 and another end connected to canister 113.

Canister 113 has an adsorbent, not shown, such as activated charcoal accommodated therein, and includes a gas-tight closed container. Canister 113 adsorbs in its adsorbent evaporative emission flowing from fuel tank 101 through tank-side pipe 121 for temporal accumulation thereof.

Engine-side pipe 114 serves to flow evaporative emission into intake pipe 121, and has one end connected to canister 113 and another end connected to intake pipe 121.

Purge control valve 115 comprising a solenoid valve is provided to engine-side pipe 114, and has an inlet port connected to canister 113 and an outlet port connected to intake pipe 121. Purge control valve 115 is opened and closed by ECU 119 to conduct communication and shutoff of engine-side pipe 114.

When purge control valve 115 is opened, the negative pressure generated in intake pipe 121 during engine operation, i.e. intake depression, is applied to canister 113 through engine-side pipe 114, purge control valve 115, and the like, thereby sucking and discharging evaporative emission in fuel tank 101 into intake pipe 121 through canister 113 and the like.

Air introduction pipe 116 serves to introduce air or atmospheric pressure into canister 113, and has one end opening into the atmosphere and another end connected to canister 113.

Air introduction valve 117 comprising a solenoid valve is provided to air introduction pipe 116. Air introduction valve 117 is opened and closed by ECU 119 to conduct communication and shutoff of air introduction pipe 116. When purge control valve 115 is opened to apply engine-side intake depression to canister 113, air introduction valve 17 is opened to introduce air into canister 113 through air introduction pipe 116.

When purge control valve 115 and air introduction valve 117 are closed, spaces in fuel tank 101, tank-side pipe 112, canister 113, and engine-side pipe 114 form closed spaces isolated with respect to intake pipe 121 and the outside. Then, by increasing the pressure within the closed spaces by switchable pump 102, gas-tightness diagnosis processing is conducted to diagnose the gas-tightness of the closed spaces.

A pressure sensor 118 serves to sense the pressure within fuel tank 101 and the like so as to conduct gas-tightness diagnosis processing. Specifically, pressure sensor 118 senses the pressure within the spaces closed by purge control valve 115 and air introduction valve 117 with the gas-tightness maintained, i.e. spaces in fuel tank 101, tank-side pipe 112, canister 113, and engine-side pipe 114. In the fourth embodiment, pressure sensor 118 is provided to tank-side pipe 112 to output a sensed signal to ECU 119.

ECU or diagnosis means 119 comprising a microcomputer has an input side connected to pressure sensor 118 and the like and an output side connected to switchable pump 102, intake-side selector valve 104, delivery-side selector valve 105, purge control valve 115, air introduction valve 117, injection valves 126, and the like.

During engine operation, ECU 119 conducts engine control. At engine control, selector valves 104, 105 are maintained at fuel-pump position (A) so that switchable pump 102 is driven as a fuel pump together with injection valves 126. With this, fuel in fuel tank 101 is fed to engine main body 120 by switchable pump 102, and is injected from injection valves 126 into engine cylinders, not shown.

Moreover, ECU 119 conducts epavopurge control. At evapopurge control, when the engine is operated under predetermined conditions (for example, when a throttle valve 123 as will be described later is in medium opening except full opening and full closing), purge control valve 115 and air introduction valve 117 are opened. Otherwise, purge control valve 115 and air introduction valve 117 are closed. With this, evaporated emission generated in fuel tank 101 is accumulated in canister 113, which is discharged into intake pipe 121 at appropriate timing.

When the engine stops, for example, ECU 119 conducts gas-tightness diagnosis on various components such as fuel tank 101, tank-side pipe 112, canister 113, engine-side pipe 114, purge control valve 115, and air introduction valve 117. At gas-tightness diagnosis processing, purge control valve 115 and air introduction valve 117 are closed, and selector valves 104, 105 are switched to air-pump position (B) so that switchable pump 102 is driven as an air pump. With this, the pressure within fuel tank 101 is increased by switchable pump 102, which is sensed by pressure sensor 118. In accordance with the sensed pressure, ECU 119 determines whether or not the gas-tightness of the components is maintained, thereby conducting the trouble diagnosis thereon.

Engine main body 120 is to be mounted on the vehicle as part of an internal combustion engine. Intake pipe 121 serves to suck outside air as intake air into cylinders of engine main body 120, and has one end connected to the cylinders and another end connected to an air cleaner 122 for clarifying intake air. Throttle valve 123 is provided to intake pipe 121 so as to control the intake-air amount of engine main body 120. First fuel feed pipe 124 serves to feed fuel in fuel tank 101 to engine main body 120, and has one end connected to fuel delivery pipe 108 and another end connected to a second fuel feed pipe 125 of engine main body 120. Injection valves 126 are provided to second fuel pipe 125 so as to inject fuel into the cylinders.

Figure 10:
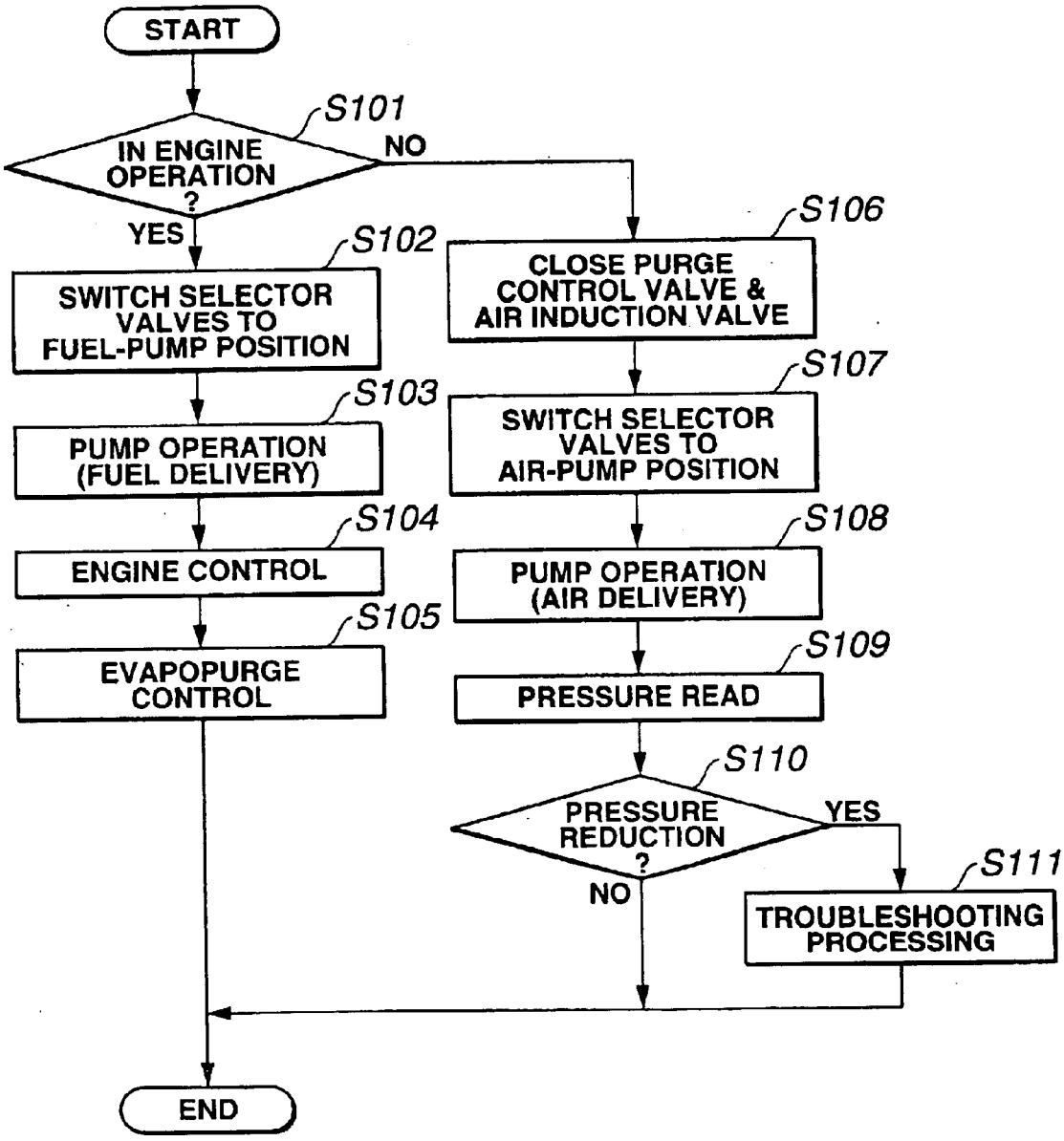
FIG. 10 is a chart similar to FIG. 3, illustrating the operation of the fourth embodiment.

Next, referring to FIG. 10, the operation of the fourth embodiment is described.

At a step S101, it is determined whether or not the engine is in operation. If it is determined that the answer is YES, flow proceeds to a step S102 where selector valves 104, 105 are switched to fuel-pump position (A). At a step S103, switchable pump 102 is operated to feed fuel in fuel tank 101 to engine main body 120. At a step S104, engine control such as fuel injection control with injection valves 126 or the like is conducted for engine operation.

Figure 11:
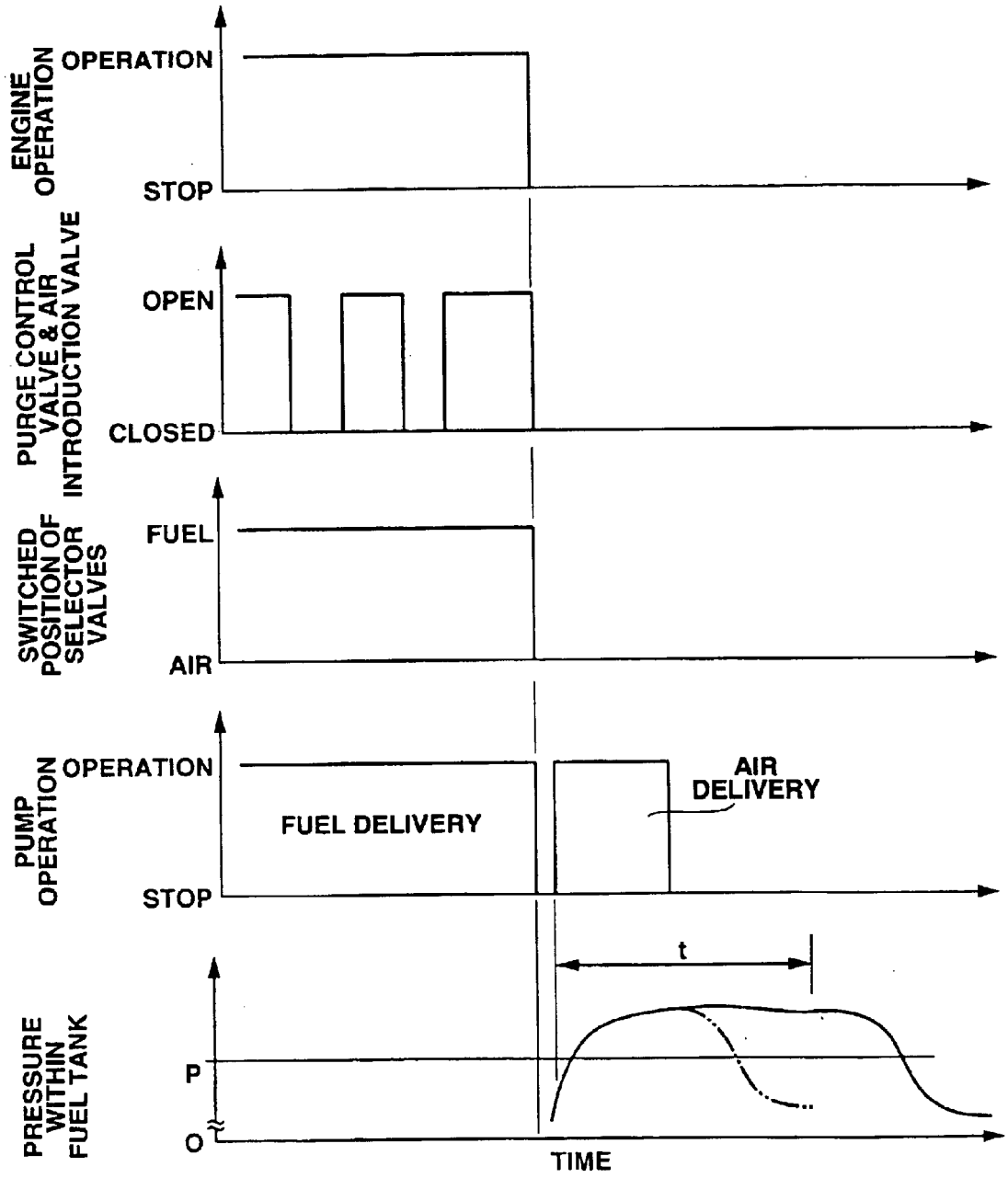
FIG. 11 is a chart similar to FIG. 4, showing the operating state of the engine, purge control valve, air introduction valve, intake-side selector valve, delivery-side selector valve, and pump and the pressure within the fuel tank.
Figure 12:
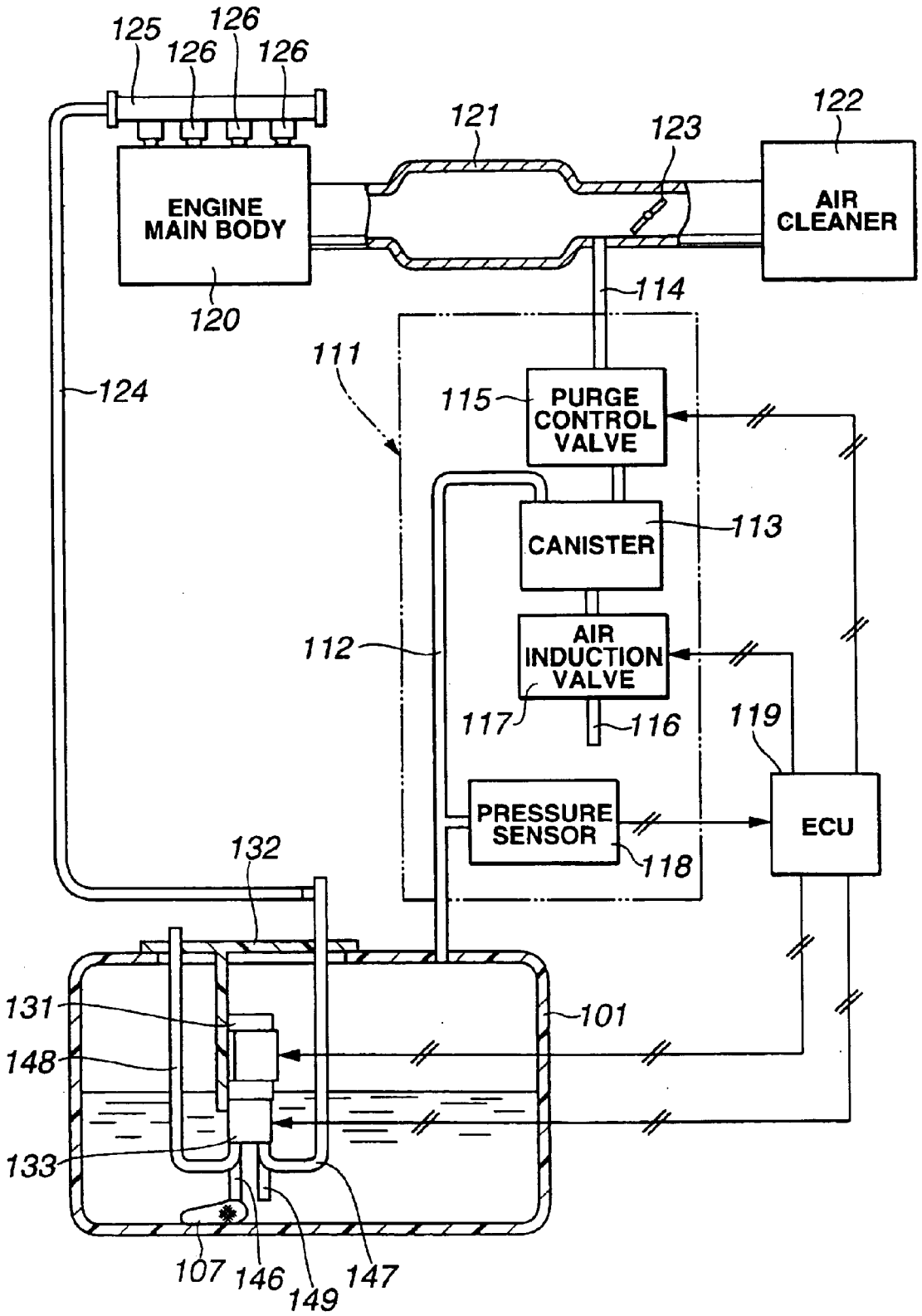
FIG. 12 is a diagram similar to FIG. 7, showing a fifth embodiment of the present invention.

At a step S105, evapopurge control is conducted to open and close purge control valve 115 and air introduction valve 117 in accordance with engine operating conditions as shown in FIG. 11. With this, when a driver maintains throttle valve 123 in medium opening, for example, evaporated emission generated in fuel tank 101 is discharged into intake pipe 121 through evapopurge apparatus 111. In this case, undergoing the negative pressure generated in intake pipe 121, i.e. intake depression, at a position closer to engine main body 120 than throttle valve 123, evaporated emission is sucked into the cylinders without leaking outside for burning with intake air.

On the other hand, at step S101, if it is determined that the answer is NO, i.e. the engine is stopped, flow proceeds to a step S106 where purge control valve 115 and air introduction valve 117 are both closed to isolate fuel tank 101, evapopurge apparatus 111, and the like with respect to the outside so as to conduct gas-tightness diagnosis processing.

At a step S107, selector valves 104, 105 are switched to air-pump position (B). At a step S108, switchable pump 102 is operated for a predetermined time as shown in FIG. 11, feeding air outside fuel tank 101 thereinto. With this, the pressure within fuel tank 101 with the gas-tightness maintained is increased to a higher value than a predetermined evaluation value P as shown in FIG. 11.

At a step S109, it is read the pressure within fuel tank 101 sensed by pressure sensor 118. At a step S110, it is determined whether or not a sensed value of the pressure is reduced under evaluation value P within a predetermined time "t" with respect to starting time of switchable pump 102, for example.

At step S110, if it is determined that the answer is YES, the pressure within fuel tank 101 is reduced in a short time as shown by imaginary line in FIG. 11, for example, so that it is diagnosed that the gas-tightness is decreased due to trouble or damage of any of the components such as fuel tank 101, tank-side pipe 112, canister 113, engine-side pipe 114, purge control valve 115, air introduction valve 117, and the like.

Then, flow proceeds to a step S1 where troubleshooting processing is conducted, and it comes to an end. Thus, the trouble diagnosis on the fuel feed system with evapopurge function and its troubleshooting can be carried out securely, resulting in enhanced reliability of the system.

On the other hand, at step S110, if it is determined that the answer is NO, the gas-tightness of the components is maintained as shown by solid line in FIG. 11, so that it is diagnosed that all the components are normal. Then, flow comes to an end without conducting processing at step S111.

In the fourth embodiment, inlet port 102A of switchable pump 102 is connected to fuel intake pipe 106 and air intake pipe 109 through intake-side selector valve 104, whereas outlet port 1-2B is connected to fuel delivery pipe 108 and air delivery pipe 110 through delivery-side selector valve 105.

Thus, when selector valves 104, 105 are switched to fuel-pump position (A), switchable pump 102 can be operated as a fuel pump. With this, fuel in fuel tank 101 can stably be fed to engine main body 120 by switchable pump 102, resulting in favorable operation of the engine.

Further, during engine stop, selector valves 104, 105 are switched to air-pump position (B) so that switchable pump 102 can be operated as an air pump. With this, when ECU 119 conducts gas-tightness diagnosis processing, the pressure within fuel tank 101, evapopurge apparatus 111, and the like can be increased by switchable pump 102, wherein a pressure variation is sensed to allow secure gas-tightness diagnosis on fuel tank 101, evapopurge apparatus 111, and the like.

Therefore, since switchable pump 102 can provide a combination of a fuel pump and an air pump, the fuel feed system needs no separate and distinct pumps for conducting fuel feed and gas-tightness diagnosis, resulting in a reduction in number of components such as pump. This also results in a reduction in weight and size of the system as a whole and in manufacturing cost thereof, and thus excellent mountability of the system with evapopurge function on the vehicle and the like.

Still further, since intake-side selector valve 104 and delivery-side selector valve 105 are provided to inlet port 102A and outlet port 102B of switchable pump 102, and they are switched together, switchable pump 102 can be connected to fuel pipes 106, 108 at fuel-pump position (A) and to air pipes 109, 110 at air-pump position (B) with secure achievement of such connection switching. Therefore, the fuel/air switchable pump means can easily be obtained using a general-purpose pump, selector valve, and the like, for example.

Furthermore, since switchable pump 102 is designed to be arranged in fuel tank 101, an installation space for switchable pump 102 can easily be secured through the use of a space in fuel tank 101, resulting in a reduction in number of components arranged outside of fuel tank 101 and in its installation space. Moreover, since switchable pump 102 serves as both a fuel pump and an air pump, the tank capacity can fully be secured as compared with separate and distinct arrangement of two pumps in fuel tank 101.

Further, since the only need is to provide to inlet port 102A of switchable pump 102 air intake pipe 109 having minimum dimension to extend outward of fuel tank 101, for example, air delivery pipe 110 can be formed of a short pipe member and the like directly opening into a space in fuel tank 101. This leads to no necessity of long routing of pipes and the like from the air pump in contrast to the earlier art, achieving simplified pipe structure.

Therefore, during the design of vehicles, the layout of switchable pump 102, pipes 109, 110, and the like can efficiently be conducted through the use of fuel tank 101. Moreover, by accommodating switchable pump 102 and the like in fuel tank 101, an installation space for other components can be increased outside fuel tank 101, resulting in effective use of a limited space of the vehicle.

Referring to FIGS. 12–17, there is shown fifth embodiment of the present invention that is substantially the same in structure as the fifth embodiment except intake-side and delivery-side switching means are integrated as a valve unit.

Figure 13:
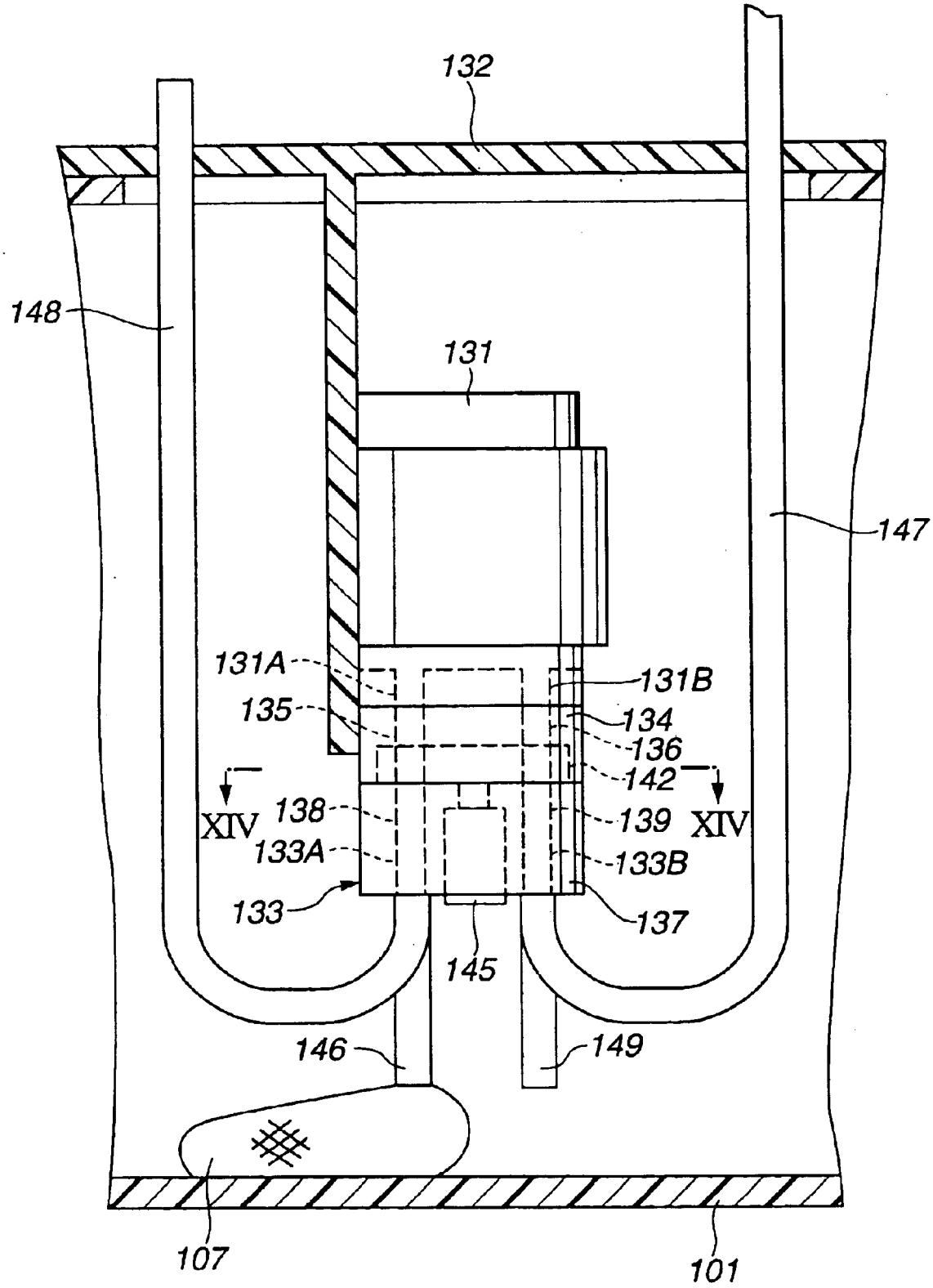
FIG. 13 is a fragmentary enlarged sectional view showing the switchable pump and a valve unit in FIG. 12.

A fuel/air switchable pump or pump means 131 is a combination of a fuel pump and an air pump in a roughly similar way to the pump 102 in the fifth embodiment. Referring to FIG. 13, switchable pump 131 comprises an electric pump including an inlet port 131A and an outlet port 131B, and is arranged in fuel tank 101 through a bracket 132 and the like. Switchable pump 131 is connected to ECU 119.

When a valve unit 133 as will be described later is switched to a fuel-pump position (see FIGS. 14 and 16), switchable pump 131 discharges fuel in fuel tank 101 to engine main body 120, whereas valve unit 133 is switched to an air-pump position (see FIGS. 15 and 17), air outside fuel tank 101 is discharged into fuel tank 101.

Referring to FIGS. 13–17, valve unit or switching means 133 is mounted to switchable pump 131, and comprises a pump-side casing 134, a pipe-side casing 137, a disc valve element 142, a valve-element drive 145, and the like as will be described later. An intake-side selector valve 133A and a delivery-side selector valve 133B are integrated with each other.

Intake-side selector valve 133A comprises a pump-intake-side port 135, a fuel inlet port 138, an air inlet port 140, an intake-side communication opening 143, and the like as will be described later. Selector valve 133A switchably connects to inlet port 131A of switchable pump 131 one of a fuel intake pipe 146 and an air intake pipe 148 as will be described later.

Delivery-side selector valve 133B comprises a pump-delivery-side port 136, a fuel outlet port 139, an air outlet port 141, a delivery-side communication opening 144, and the like as will be described later. Through its operation together with intake-side selector valve 133A, delivery-side selector valve 133B switchably connects to outlet port 131B of switchable pump 131 one of a fuel delivery pipe 147 and an air delivery pipe 149 as will be described later.

Pump-side casing 134 is mounted to switchable pump 131, and is shaped like a lidded cylinder having a lid 134A at a pump-side part. Pump-side casing 134 has on the inner periphery a valve-element accommodation opening 134B formed like a circular concave.

Lid 134A is formed with pump-intake-side port 135 communicating with inlet port 131A of switchable pump 131 and pump-delivery-side port 136 communicating with outlet port 131B. Ports 135, 136 are distantly disposed in the direction of rotation or the circumferential direction to open into valve-element accommodation opening 134.

Pipe-side casing 137 is connected to pump-side casing 134 to close valve-element accommodation opening 134B. Pipe-side casing 137 is formed with fuel inlet port 138, fuel delivery port 139, air inlet port 140, and air delivery port 141 that open into valve element 142. Pipes 146–149 as will be described later are connected to pipe-side casing 137.

Figure 14:
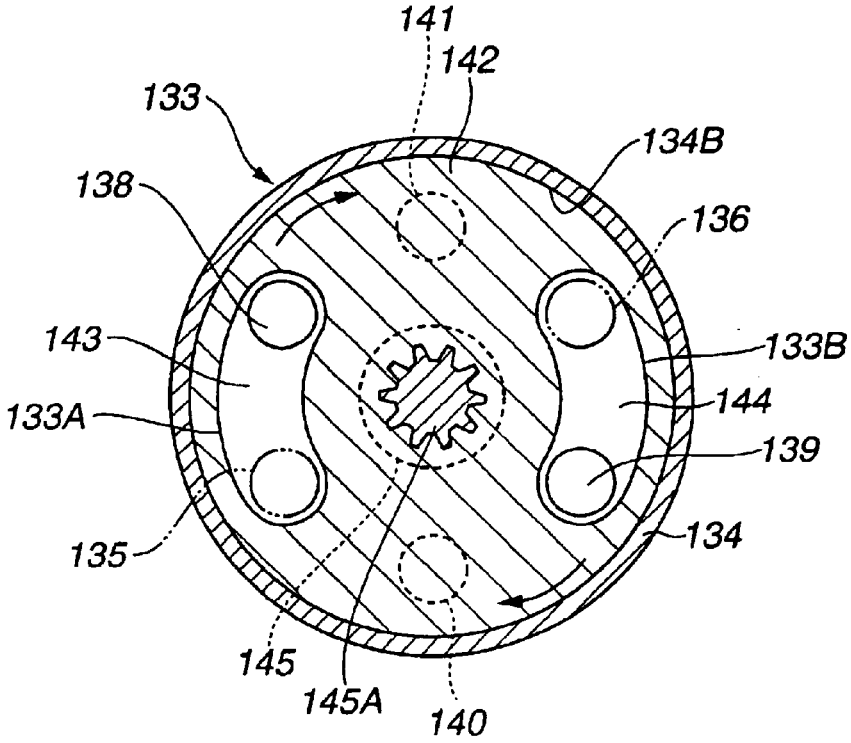
FIG. 14 is a cross sectional view taken along the line XIV—XIV in FIG. 13 and showing the valve unit switched to the fuel-pump position.
Figure 15:
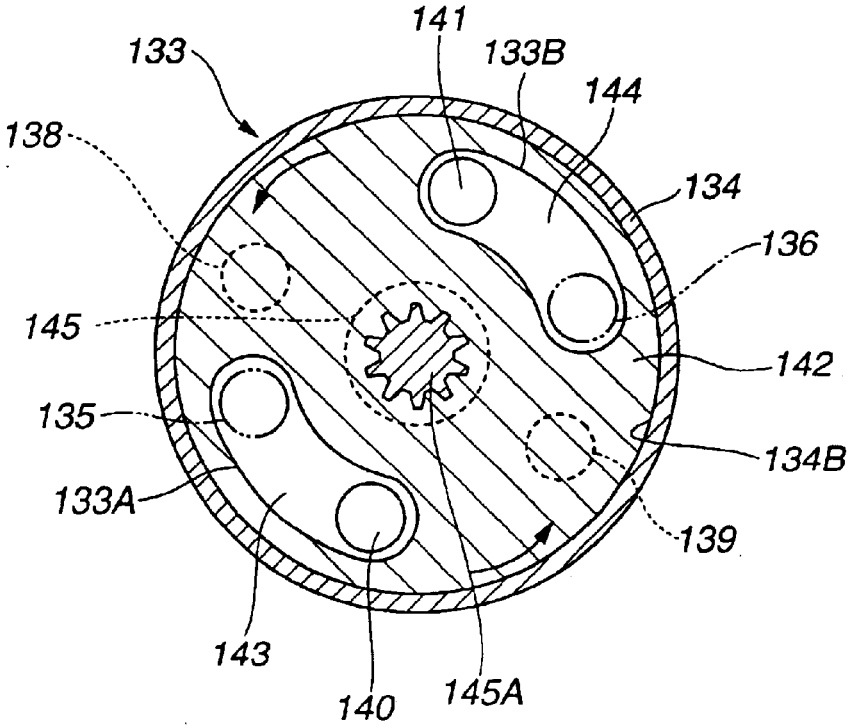
FIG. 15 is a view similar to FIG. 14, showing the valve unit switched to the air-pump position.

As shown in FIGS. 14 and 15, fuel inlet port 138 is disposed offset in one direction of rotation of valve element 142, e.g. clockwise direction, with respect to pump-intake-side port 135, whereas air inlet port 140 is disposed offset in another direction of rotation, e.g. counterclockwise direction, with respect thereto. That is, fuel inlet port 138 and air inlet port 140 are disposed on both sides of pump-intake-side port 135 in the direction of rotation. Likewise, fuel delivery port 139 and air delivery port 141 are disposed on both sides of pump-delivery-side port 136 in the direction of rotation.

Disc valve element 142 is rotatably accommodated in valve-element accommodation opening 134B of pump-side casing 134, and is rotated between the fuel-pump position and the air-pump position by valve element drive 145. Valve element 142 has a surface and a reverse that make slide contact with pump-side casing 134 and pipe-side casing 137, respectively, in a gas-tight and fluid-tight way. Valve element 142 is formed with intake-side communication opening 143 and delivery-side communication opening 144.

Intake-side communication opening 143 is arranged through valve element 142 in the direction of thickness, and is shaped like a circular slot extending in the direction of rotation of valve element 142. Even with valve element 142 switched to any of the fuel-pump position and the air-pump position, communication opening 143 always communicates with pump-intake-side port 135 on the side of the surface of valve element 142.

When valve element 142 is switched to the fuel-pump position, intake-side communication opening 143 communicates with fuel inlet port 138, and is isolated from air inlet port 140 on the side of the reverse of valve element 142. When valve element 142 is switched to the air-pump position, communication opening 143 is isolated from air inlet port 138, and communicates with air inlet port 140.

Delivery-side communication opening 144 is arranged through valve element 142, and is shaped like a circular slot in a roughly similar way to intake-side communication opening 143. At the fuel-pump position and the air-pump position, communication opening 144 always communicates with pump-delivery-side port 136. At the fuel-pump position, communication opening 144 communicates with fuel outlet port 139, and is isolated from air outlet port 141. At the air-pump position, communication opening 144 is isolated from fuel outlet port 139, and communicates with air outlet port 141.

Valve-element drive 145 is provided to valve unit 133, and comprises an actuator such as an electric motor. Valve-element drive 145 is arranged inside pipe-side casing 137, and is connected to ECU 119. A drive gear 145A is arranged at the output of valve-element drive 145, and is engaged in the center thereof with rotation prevented. Valve-element drive 145 rotates valve element 142 in accordance with a switching signal out of ECU 119 to switch valve element 142 between the fuel-pump position and the air-pump position.

Fuel intake pipe 146 is connected to fuel inlet port 138 of valve unit 133. In a roughly similar way to the fourth embodiment, when valve element 142 is switched to the fuel-pump position, fuel intake pipe 146 is operative to lead fuel in fuel tank 101 to switchable pump 131.

Fuel delivery pipe 147 is connected to fuel delivery port 139 of valve unit 133, and serves to lead fuel from switchable pump 131 to engine main body 120 at the fuel-pump position.

Air intake pipe 148 is connected to air inlet port 140 of valve unit 133, and serves to lead air outside fuel tank 101 to switchable pump 131 at the air-pump position.

Air delivery pipe 149 is connected to air delivery port 141 of valve unit 133, and serves to lead air from switchable pump 131 to fuel tank 101 at the air-pump position.

Figure 16:
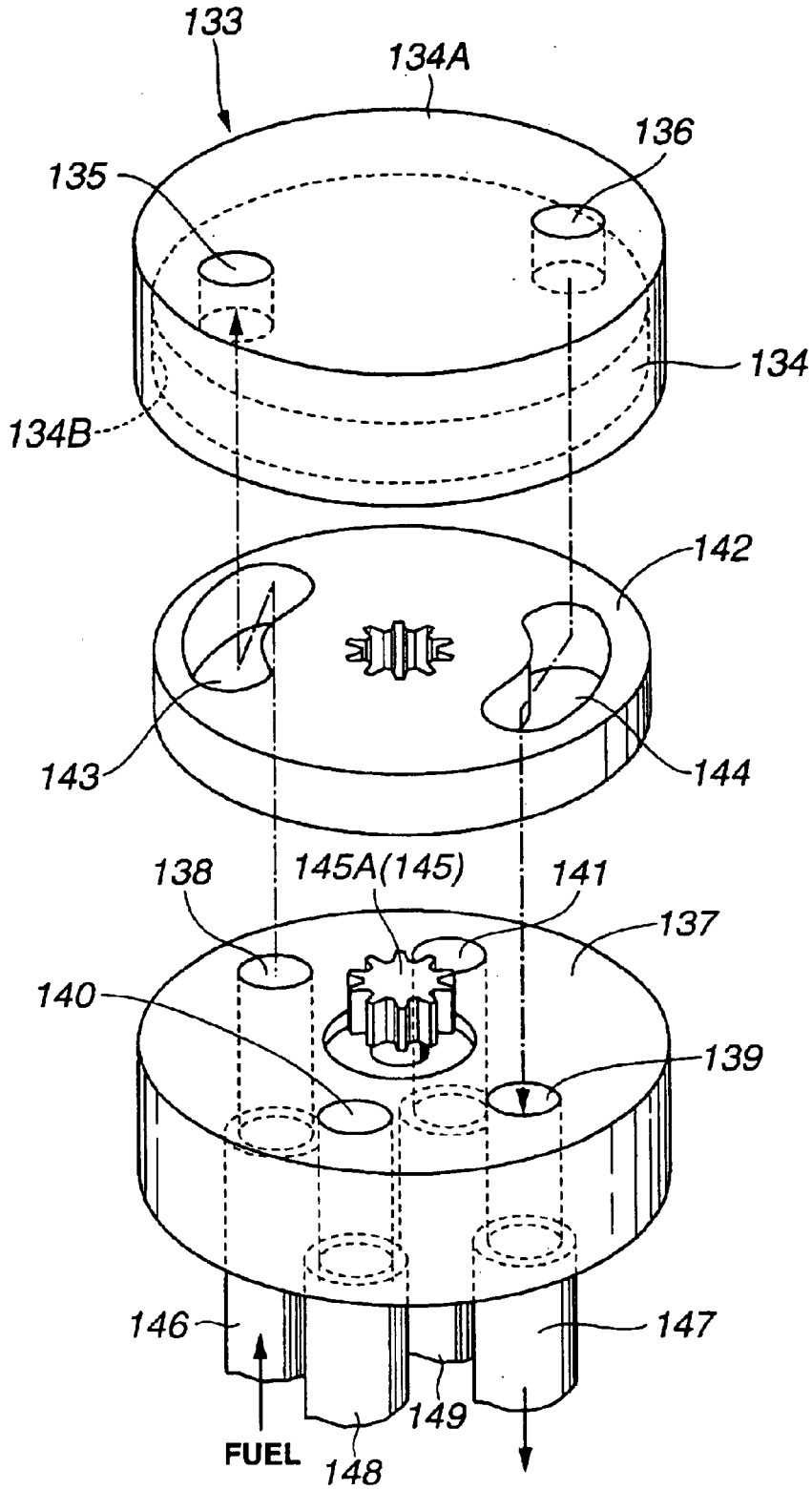
FIG. 16 is an exploded perspective view showing the valve unit switched to the fuel-pump position.

Next, the operation of valve unit 133 is described. Referring to FIG. 16, when valve element 142 is switched to the fuel-pump position, switchable pump 131 has inlet port 131A (pump-intake-side port 135) connected to fuel intake pipe 146 through intake-side communication opening 143 and fuel inlet port 138, and outlet port 131B (pump-delivery-side port 136) connected to fuel delivery pipe 147 through delivery-side communication opening 144 and fuel outlet port 139.

With this, switchable pump 131 can suck fuel in fuel tank 101 from fuel intake pipe 146 through inlet port 131A, and discharge fuel to fuel delivery pipe 147 through outlet port 131B, thus achieving feed of discharged fuel to engine main body 120.

Figure 17:
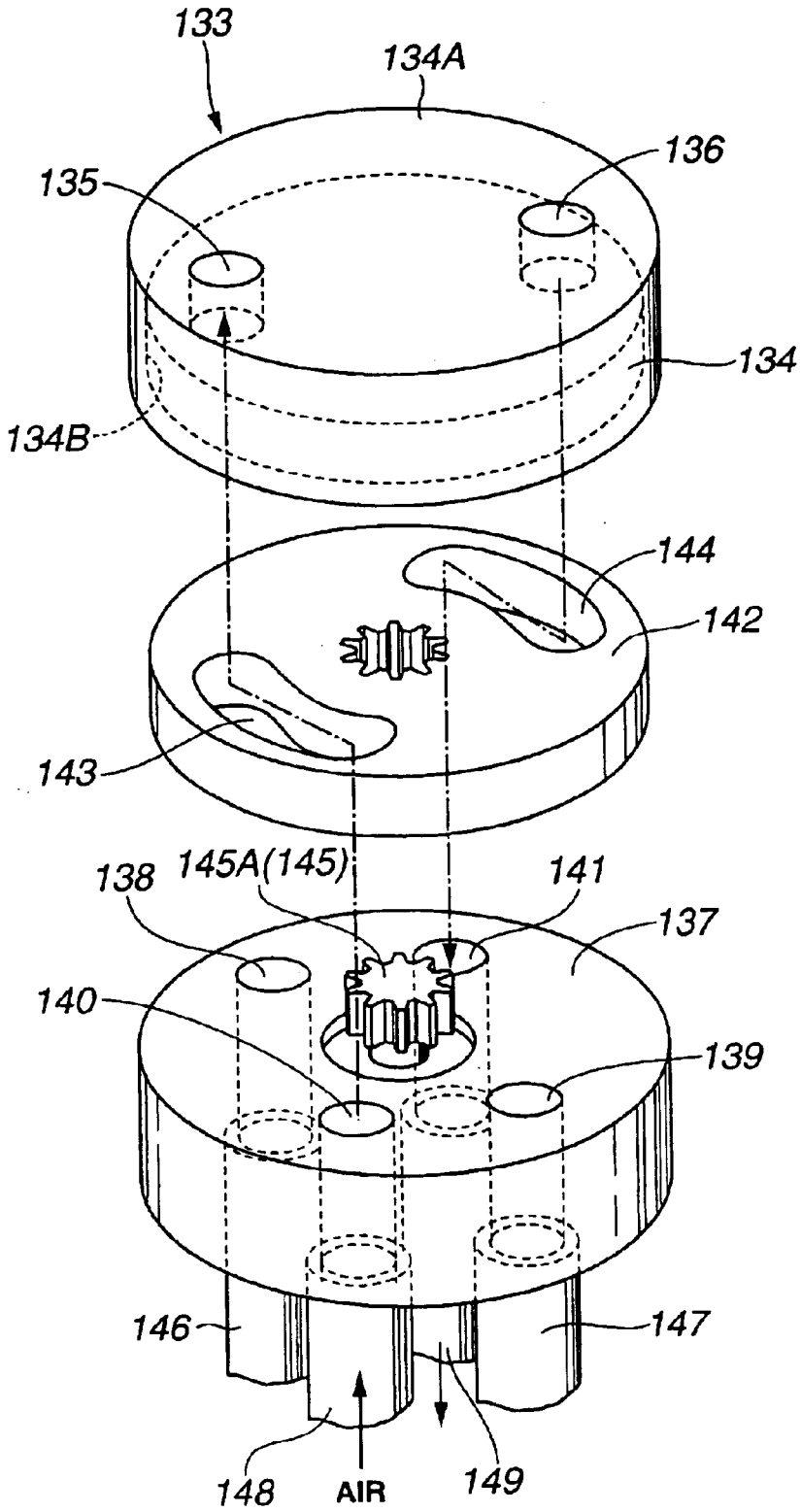
FIG. 17 is a view similar to FIG. 16, showing the valve unit switched to the air-pump position.

On the other hand, referring to FIG. 17, when valve element 142 is switched to the air-pump position, pump-intake-side port 135 is connected to air intake pipe 148 through intake-side communication opening 143 and air inlet port 140, whereas pump-delivery-side port 136 is connected to air delivery pipe 149 through delivery-side communication opening 144 and air outlet port 141.

With this, switchable pump 131 can suck air outside fuel tank 101 from air intake pipe 148 through inlet port 131A, and discharge fuel from air delivery pipe 149 to fuel tank 101 through outlet port 131B, wherein gas-tightness diagnosis processing can be conducted by closing purge control valve 115 and air introduction valve 117.

Thus, the fifth embodiment can produce substantially the same effect as that of the fourth embodiment. Particularly, in the fifth embodiment, since intake-side selector valve 133A and delivery-side selector valve 133B are integrated as valve unit 133, two selector valves 133A, 133B can be obtained using disc valve element 142 of simple shape, and driven together by valve-element drive 145.

With this, there is no need to provide a valve element, a valve-element drive, and the like to selector valves 133A, 133B, respectively, resulting in reduced number of components of valve unit 33 as a whole and thus simplified structure thereof. Moreover, since disc valve element 142 allows a reduction in thickness of the unit as a whole, valve unit 133 including two selector valves 133A, 133B can be formed with reduced size.

Further, selector valves 133A, 133B can be switched by simple action of rotating valve element 142, resulting in enhancement in durability and reliability. Still further, the only need is to connect a signal output terminal, a signal line, and the like of ECU 119 to single valve-element drive 145, resulting in reduced number thereof and thus simplified structure of the system as a whole.

Figure 18:
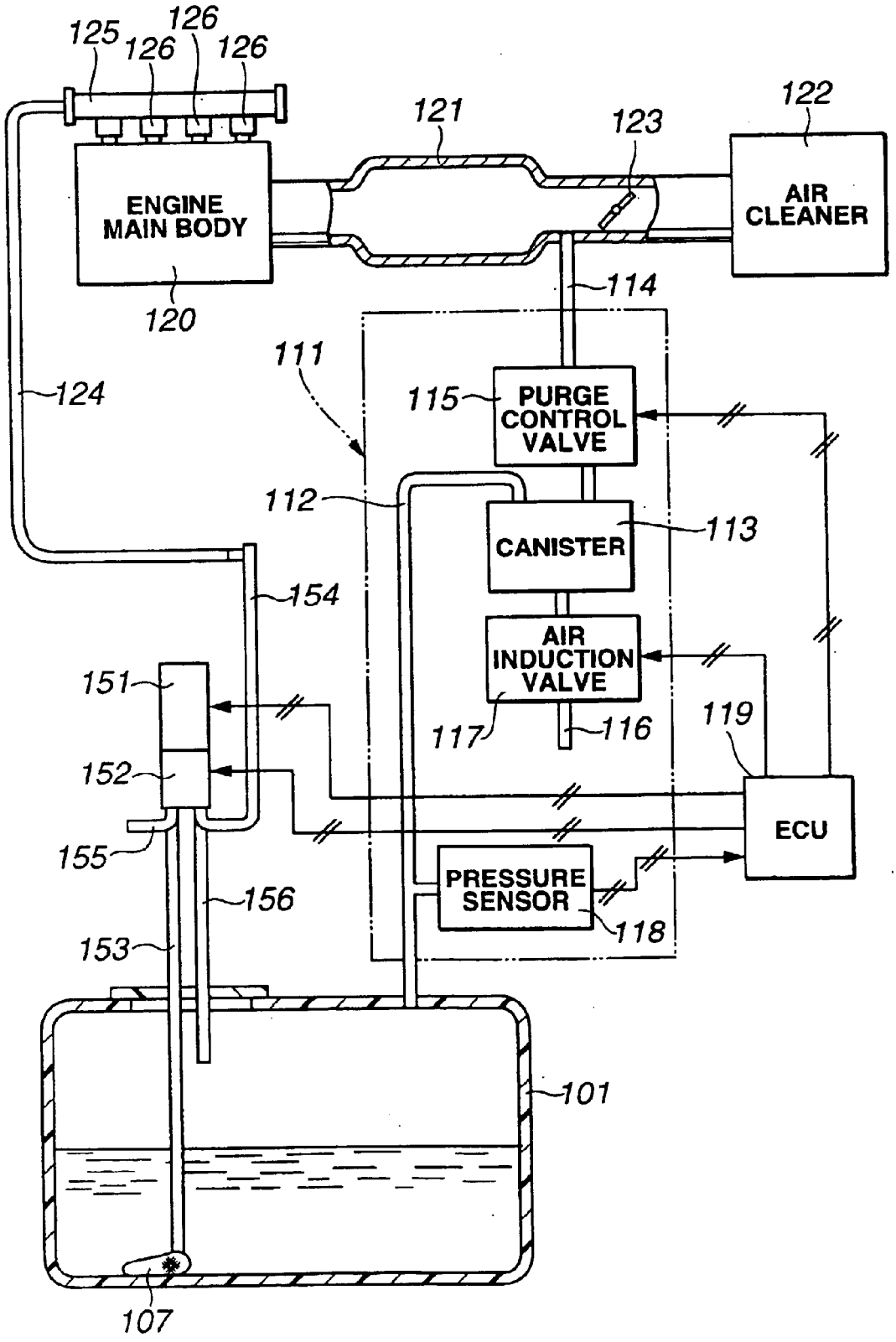
FIG. 18 is a view similar to FIG. 12, showing a sixth embodiment of the present invention.

Referring to FIG. 18, there is shown sixth embodiment of the present invention that is substantially the same in structure as the fourth embodiment except that the pump means are arranged outside the fuel tank.

An air/fuel switchable pump or pump means 151 has a valve unit 152 mounted thereto in a roughly similar way to the fifth embodiment. Connected to valve unit 152 are a fuel intake pipe 153, a fuel delivery pipe 154, an air intake pipe 155, and an air delivery pipe 156.

However, switchable pump 151 and valve unit 152 are arranged outside fuel tank 101, wherein fuel intake pipe 153 and air intake pipe 155 extend to the inside of fuel tank 101.

Thus, the sixth embodiment can produce substantially the same effect as that of the fourth embodiment. Particularly, in the sixth embodiment, switchable pump 151 and valve unit 152 can be arranged outside fuel tank 101 considering the structure of fuel tank 101 and the routing of pipes 53–56, for example, resulting in enhancement in design flexibility of the fuel feed system.

In the fourth to sixth embodiments, fuel delivery valve 6 and air intake valve 8 include a check valve. Optionally, referring to FIG. 6, the two valves may be constructed as shown in the third embodiment, wherein a fuel delivery valve 6' includes a normally-open solenoid open/close valve or the like, and an air intake valve 8' includes a normally-closed solenoid open/close valve or the like. When switchable pump 2 is driven as a fuel pump, fuel delivery valve 6' and air intake valve 8' receive no switching signal from ECU 17, and thus are maintained at respective fuel delivery positions (A), wherein fuel delivery valve 6' is opened, and air intake valve 8' is closed. On the other hand, when switchable pump 2 is driven as an air pump, fuel delivery valve 6' and air intake valve 8' receive switching signals from ECU 17, and thus are switched to respective air intake positions (B), wherein fuel delivery valve 6' is closed, and air intake valve 8' is opened.

In the illustrative embodiments, the pipes are used as a passage for fuel or air. Optionally, the passage may be in the form of an internal space., clearance, groove, hole, and the like defined by components constituting the fuel feed system.

Further, in the illustrative embodiments, the pressure sensor is provided to tank-side pipe. Optionally, the pressure sensor may be arranged in the fuel tank, the tank-side pipe, the canister, and the engine-side pipe at any site where the pressure can be sensed.

Still further, in the illustrative embodiments, the valve unit is mounted to the switchable pump. Optionally, the valve unit may be arranged separately from the switchable pump, wherein the two are connected each other by a pipe and the like.

Furthermore, in the illustrative embodiments, the present invention is applied to a fuel feed system for vehicles such as automobile. Alternatively, the present invention can be applied to various fuel feed systems for other purposes.

Having described the present invention with regard to the illustrative embodiments, it is noted that the present invention is not limited thereto, and various changes and modifications can be made without departing from the scope of the present invention.

The entire teachings of Japanese Patent Application P2002-362655 filed Dec. 13, 2002 and Japanese Patent Application P2002-362654 filed Dec. 13, 2002 are incorporated hereby by reference.

What is claimed is:

1. A system for feeding fuel to an internal combustion engine, comprising:

a tank that accumulates evaporative fuel;

a fuel and air switchable pump that sucks and discharges the accumulated fuel and air outside the tank;

a first device that allows the accumulated fuel to be discharged to the engine;

a second device that allows the outside air to be sucked into the tank; and an electronic control unit (ECU) that controls the pump.

2. The system as claimed in claim 1, wherein the first device comprises a delivery valve, and the second device comprises an intake valve, the delivery valve and the intake valve being operative when the pump rotates in first and second directions.

3. The system as claimed in claim 2, wherein the ECU conducts gas-tightness diagnosis on the tank, the diagnosis being carried out such that when the engine is stopped, the pump is rotated in the second direction to increase a pressure within the tank.

4. The system as claimed in claim 2, further comprising:

an evapopurge apparatus that conducts communication between the engine and the tank when the engine is operated with the pump rotated in the first direction, the evapopurge apparatus discharging fuel vapor evaporated in the tank to an intake of the engine, wherein the ECU conducts gas-tightness diagnosis on the tank and the evapopurge apparatus, the diagnosis being carried out such that when the engine is stopped, the pump is rotated in the second direction, and the evapopurge apparatus is isolated from the outside, increasing a pressure within the tank and the evapopurge apparatus.

5. The system as claimed in claim 4, wherein the evapopurge apparatus comprises a canister, a purge control valve, and an air introduction valve.

6. The system as claimed in claim 1, wherein the pump is arranged inside the tank.

7. The system as claimed in claim 1, wherein the pump is arranged outside the tank.

8. The system as claimed in claim 2, wherein the delivery valve and the intake valve each comprise a check valve.

9. The system as claimed in claim 2, wherein the delivery valve comprises a normally-open solenoid valve, and the intake valve comprises normally-closed solenoid valve.

10. The system as claimed in claim 1, wherein the first and second devices comprise selector valves arranged at an intake and a delivery of the pump, respectively, the selector valves being switched between a fuel-pump position and an air-pump position.

11. The system as claimed in claim 10, wherein the ECU conducts gas-tightness diagnosis on the tank, the diagnosis being carried out such that when the engine is stopped, the selector valves are switched to the air-pump position so as to increase a pressure within the tank.

12. The system as claimed in claim 10, further comprising:

an evapopurge apparatus that conducts communication between the engine and the tank when the engine is operated with the selector valves switched to the fuel-pump position, the evapopurge apparatus discharging evaporative emission evaporated in the tank to an intake of the engine, wherein the ECU conducts gas-tightness diagnosis on the tank and the evapopurge apparatus, the diagnosis being carried out such that when the engine is stopped, the selector valves are switched to the air-pump position, and the evapopurge apparatus is isolated from the outside, increasing a pressure within the tank and the evapopurge apparatus.

13. The system as claimed in claim 10, wherein the selector valves are integrated as a valve unit, wherein the valve unit further comprises a pipe-side casing, a disc valve element, and a valve-element drive.

14. A system for feeding fuel to an internal combustion engine, comprising:

a tank that accumulates evaporative fuel;

a fuel and air switchable pump that rotates in first and second directions, the pump sucking fuel accumulated in the tank and discharging it to the engine when rotating in the first direction, the pump sucking air outside the tank and discharging it into the tank when rotating in the second direction;

a delivery valve that allows fuel accumulated in the tank to be discharged to the engine when the pump rotates in the first direction;

an intake valve that allows air outside the tank to be sucked into the tank when the pump rotates in the second direction; and an electronic control unit (ECU) that controls the pump.

15. A system for feeding fuel to an internal combustion engine, comprising:

a tank that accumulates evaporative fuel;

a fuel and air switchable pump that sucks and discharges the accumulated fuel and air outside the tank;

a switching device that switches between a fuel-pump position where the accumulated fuel is sucked and discharged to the engine and an air-pump position where the outside air is sucked and discharged into the tank; and an electronic control unit (ECU) that controls the pump.

16. A system for feeding fuel to an internal combustion engine, comprising:

a tank that accumulates evaporative fuel;

fuel and air switchable pump means for sucking and discharging the accumulated fuel and air outside the tank;

first means for allowing the accumulated fuel to be discharged to the engine;

second means for allowing the outside air to be sucked into the tank; and an electronic control unit (ECU) that controls the pump means.

17. A system for feeding fuel to an internal combustion engine, comprising:

a tank that accumulates evaporative fuel;

a pump that sucks and discharges the accumulated fuel and air outside the tank;

a first device that allows the accumulated fuel to be discharged to the engine;

a second device that allows the outside air to be sucked into the tank; and an electronic control unit (ECU) that controls the pump, wherein the ECU conducts gas-tightness diagnosis on the tank, the diagnosis being carried out such that when the engine is stopped, the pump is rotated in the second direction to increase a pressure within the tank.

18. A system for feeding fuel to an internal combustion engine, comprising:

a tank that accumulates evaporative fuel;

a pump that sucks and discharges the accumulated fuel and air outside the tank;

a first device that allows the accumulated fuel to be discharged to the engine;

a second device that allows the outside air to be sucked into the tank; and an electronic control unit (ECU) that controls the pump, wherein the first and second devices comprise selector valves arranged at an intake and a delivery of the pump, respectively, the selector valves being switched between a fuel-pump position and an air-pump position.

* * * * *